US005480135A

United States Patent [19]

Nagane et al.

[11] Patent Number: 5,480,135

[45] Date of Patent: Jan. 2, 1996

[54] SHEET COLLATING OR STORAGE DEVICE

[75] Inventors: Hiromichi Nagane; Alexandre Dodge, both of Rennes; Marie-Helene Froger, Fougeres; Christophe Truffaut; Stéphane Michel, both of Rennes, all of France

[73] Assignee: Canon Kabushiki Kaisha, Tokyo, Japan

[21] Appl. No.: 159,490

[22] Filed: Nov. 30, 1993

[30] Foreign Application Priority Data

Dec. 1, 1992 [FR] France ..... 92 14461

[51] Int. Cl.[6] ..... B65H 43/00; B65H 29/42

[52] U.S. Cl. ..... 271/176; 271/179; 271/248; 271/258.01; 271/212; 271/314; 198/625

[58] Field of Search ..... 271/176, 179, 271/184, 189, 225, 248, 258, 263, 264, 212, 314; 221/75; 198/625

[56] References Cited

U.S. PATENT DOCUMENTS

| | | | |
|---|---|---|---|
| 2,048,870 | 7/1936 | Kannee | 271/71 |
| 2,300,863 | 11/1942 | Bamford | 271/79 |
| 2,650,694 | 9/1953 | Findlater | 198/625 |
| 2,970,836 | 2/1961 | Smith | 271/71 |
| 4,108,319 | 8/1978 | Kacirek et al. | 198/625 |
| 4,378,938 | 4/1983 | Staniszewski | 271/179 |
| 4,432,540 | 2/1984 | Akers et al. | 271/179 |
| 4,547,114 | 10/1985 | Watrous et al. | 271/179 |
| 4,573,676 | 3/1986 | Miyamoto et al. | 271/179 |
| 4,903,955 | 2/1990 | Manzke | 271/176 |
| 4,957,409 | 9/1990 | Fukao et al. | 414/788.4 |
| 4,974,826 | 12/1990 | Svyatsky et al. | 271/179 |

FOREIGN PATENT DOCUMENTS

| | | | |
|---|---|---|---|
| 0104923A3 | 4/1984 | European Pat. Off. . | |
| 0352179A1 | 1/1990 | European Pat. Off. . | |
| 418815 | 9/1990 | European Pat. Off. . | |
| 2125721 | 9/1972 | France . | |
| 0027164 | 3/1977 | Japan | 271/212 |
| 57-156951 | 9/1982 | Japan . | |
| 57-156950 | 9/1982 | Japan . | |
| 0170305 | 10/1982 | Japan | 198/625 |
| 235293 | 11/1944 | Switzerland | 271/44 |

OTHER PUBLICATIONS

Xerox Disclosure Journal, Jan./Feb., 1983 vol. 8 No. 1, "Bottom Stacking", T. P. Redding.

*Primary Examiner*—H. Grant Skaggs

*Attorney, Agent, or Firm*—Fitzpatrick, Cella, Harper & Scinto

[57] ABSTRACT

A device for collating sheets, in which the sheets are offered at an input of the device, which comprises conveyor member which convey the sheets in a circuit arranged between the input and an output of the device, the conveyor member comprising at least a first pair of helical ramps with a predetermined winding direction and each comprising a free end. The ramps are arranged on rotating member which rotate them about their helix axis in the opposite direction to the winding direction. The device also comprises guide and placement member, the rotation of the ramps having the effect of conveying the sheet positioned, by the guide and placement member, on a predetermined portion of each of the two ramps, along a portion at least of the circuit and toward the free end of the ramps, a first of the two ramps of the pair having an opposite winding direction in relation to the second. In a first variant, the device is characterized in that each of the ramps comes into contact with the sheet approximately transversely to the movement of arrival of the sheet to guide it laterally. In a second variant, the device is characterized in that it also comprises a second pair of ramps, arranged downstream from the first pair in relation to the movement of arrival of the sheets, the first ramps and the second ramps of each of the two pairs having respectively an identical winding direction and the first ramps of each of the two pairs having a height greater than that of the second ramps of each of the two pairs.

30 Claims, 25 Drawing Sheets

33i(34i)
33d

33d 33c
33b(34b)
VII
33c
VII

33'i(34'i)

33g
33h
33g,33h 33e,33f
33'b(34'b)
33e
33f

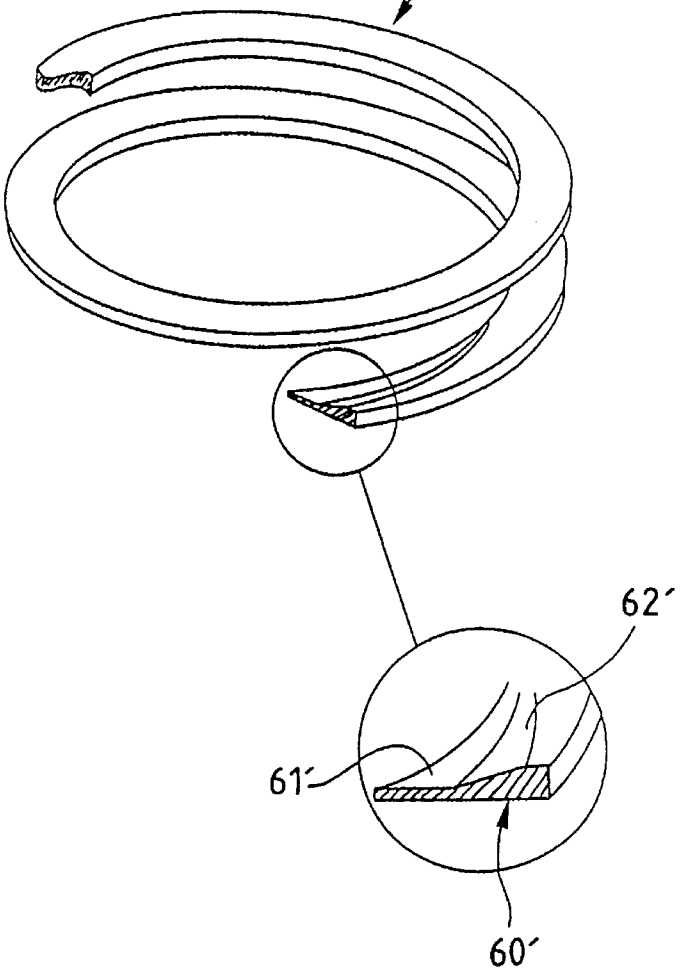
Fig.14b
Fig.14
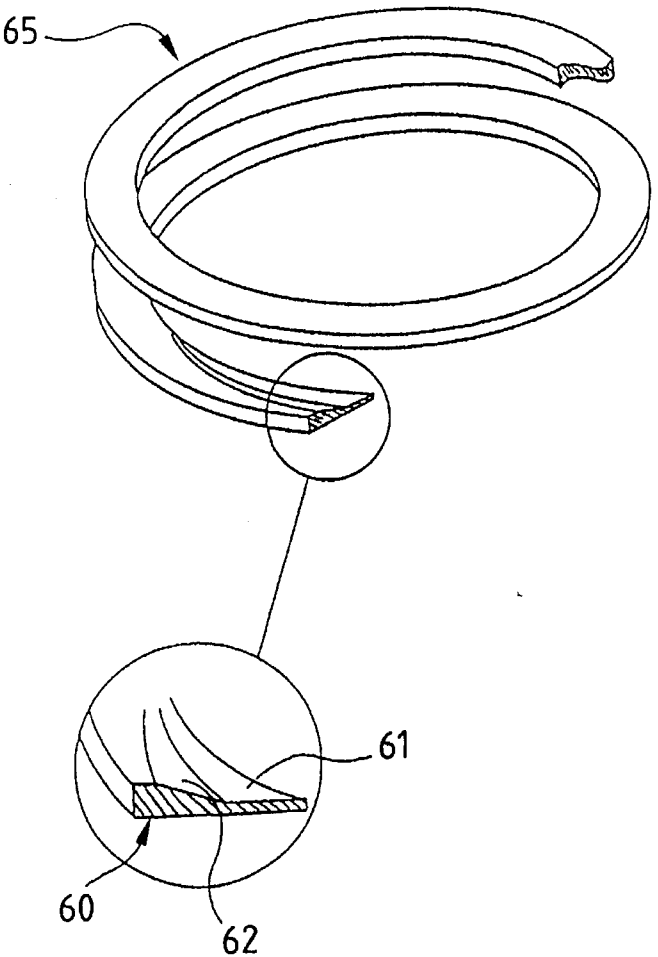
Fig.14a

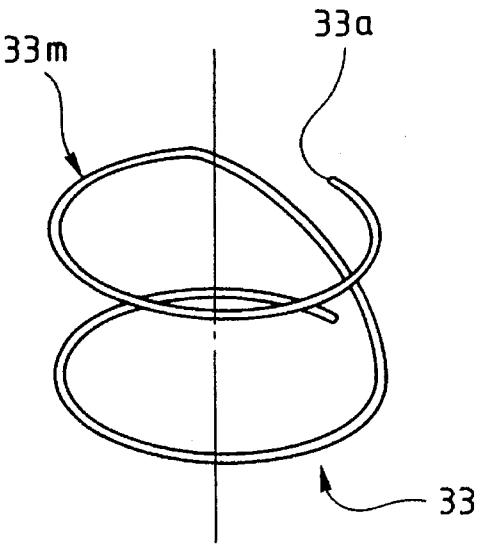
Fig.19c
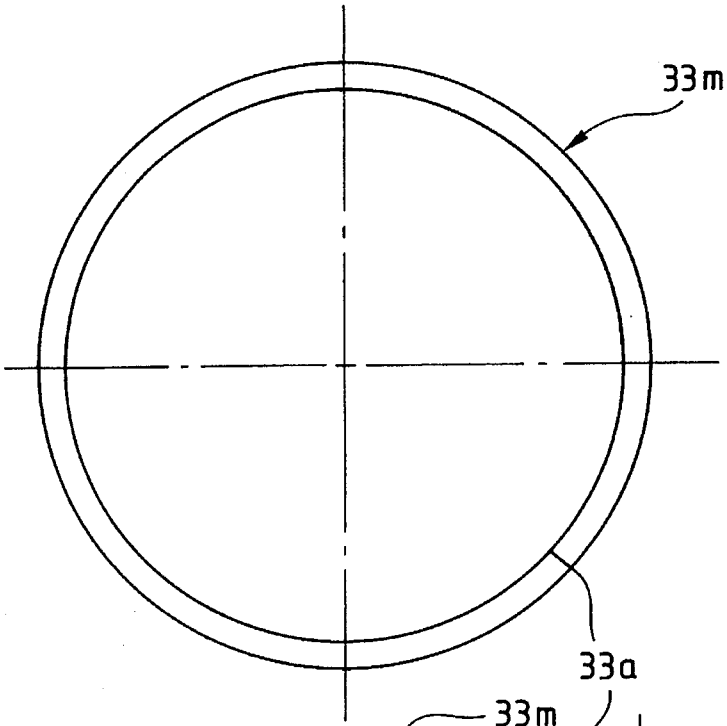
Fig.19b
Fig.19a

SHEET COLLATING OR STORAGE DEVICE

FIELD OF THE INVENTION AND RELATED ART

The present invention concerns a device for collating or storing sheets offered at an input of the device and intended to be collated preferably in the order of arrival at the output of this device. For this purpose, it comprises conveyor means which convey the sheets into a circuit arranged between the input and an output of the device.

The device according to the invention can, because of the conveyor means, convey all types of sheet, whether made of paper, cardboard, metallic or other.

More specifically, this device applies to the field of office automation for the receiving of paper printed, for example, by a facsimile apparatus, copying apparatus or printer.

In general, as shown in FIG. 1*a*, the sheets 11 printed by these machines 10 are stored at their outputs, stacked on each other, on simple trays 12.

some of these machines use ink-jet printing systems. At the printing output, the ink of a resulting copy is often not completely dry when the next copy reaches the storage system. The friction of two sheets 11, 11*a* against each other (as shown in FIG. 1*a*) spreads the ink from the first copy 11*a*, making the document illegible, or at least deteriorating its quality.

The facsimile apparatus shown in FIGS. 1*b* to 1*d* solves the problem of drying the ink. In the facsimile apparatus 20, the sheets are printed by the device shown under reference 21 and conveyed to a drying device 22 before falling (arrow 23) into the storage zone 24. FIGS. 1*c* and 1*d* show the facsimile apparatus 20 in a partial cross-section along line I—I. Shown in particular is the drying device 22 during the drying phases. It may be observed that, in a first phase (FIG. 1*c*), the printed sheet 25 is carried by support plates 26 hinged at their base. In a second phase (FIG. 1*d*), the plates 26 are retracted and the sheet 25 falls towards the storage zone 24 in the direction of arrow 23 (FIG. 1*b*).

However, for this device, of complex construction, as for the one in FIG. 1*a*, the order of arrival of the sheets is not preserved. Thus, if the sheets have been printed, in particular by a facsimile apparatus of this type, in their order of numbering, the order of sheets on arrival is in the reverse order to the numbering. To overcome this drawback, the user of the printing system using such a storage system is forced to proceed with the printing, particularly by photocopy or facsimile copy of the sheets, in the reverse order to their numbering, or to proceed with a manual rearrangement of the copies.

Document FR-A-2,125,721 discloses a unit for stacking flat objects, particularly paper products, such as newspapers, which preserves the order of arrival of the objects. As described in this patent, the objects are conveyed between a feed station and a removal station by conveyor elements in the form of helixes rotated about their longitudinal axis.

The objects are guided laterally by abutment rails placed in the interior of the conveyor helixes.

This device helps to preserve the order of the objects, but is nevertheless of complex construction because, for the lateral guidance of the newspapers, it requires particular means only performing the guiding function. In addition, due to the use of these means, this device is of a relatively large size.

Furthermore, it is mentioned in this patent that the stack of objects thus obtained arrives on the top of the conveyor helixes from which it is unloaded.

A lateral recovery of the sheets, as is generally the case in the field of office automation, is not considered.

OBJECTS OF THE INVENTION

In general, the invention has as an object to provide a new means for conveying sheets into a collating or storage device, such as those used in office automation, characterized by its simplicity of construction and maintenance, and improving the reliability of the storage device.

Another general object of the present invention is to propose a sheet-collating or storage device which:

overcomes the drawbacks mentioned above related to the drying of the sheets, and, as required, enables the sheets to preserve their initial order of arrival at the output of the device.

A particular object of the present invention is to propose a device for collating or storing sheets which simplifies and improves the lateral guiding stucture of the sheets.

Another particular object of the present invention is to propose a device for collating or storing sheets which enables easy lateral recovery of the sheets.

SUMMARY OF THE INVENTION

According to a first of its preferred embodiments, the invention proposes a sheet-collating device in which the sheets are offered at an input of this device, comprising conveyor means capable of conveying the sheets into a circuit arranged between the input and output of the device, the conveyor means comprising at least a first pair of helical ramps with a predetermined winding direction and each comprising a free end, the ramps being arranged on rotating means adapted to rotate them about their helical axis in the opposite direction to the winding direction, the device also comprising guide and placement means, the rotation of the ramps having the effect of conveying the sheet positioned, by said guide and placement means, on a predetermined portion of each of the two ramps, along a portion at least of said circuit and toward the free end of said ramps, a first of the two ramps of said pair being wound in the opposite direction to the second, the device being characterized in that each of the ramps comes into contact with the sheet approximately transversely to the movement of arrival of the sheet to guide it laterally.

According to a second of its variants, the present invention proposes a sheet collating device for collating sheets which are offered to an input of the device which comprises conveyor means adapted to convey the sheets in a circuit arranged between the input and output of the device, the conveyor means comprising at least a first pair of helical ramps having a predetermined winding direction and each comprising a free end, the ramps being arranged on rotating means adapted to rotate them about their helix axis in the opposite direction to the winding direction, the device further comprising guide and placement means, the rotation of the ramps conveying the sheet positioned by said guide and placement means, on a predetermined portion of each of the two ramps, along at least part of said circuit and toward the free end of said ramps, a first of the two ramps of said pair having, in relation to the second, a reverse winding, said device being characterized in that it also comprises a second pair of ramps, arranged downstream from said first pair in relation to the movement of arrival of the sheets, the first ramps and the second ramps of each of the two pairs having respectively an identical winding direction and the first ramps of each of the two pairs having a height greater than that of the second ramps of each of the two pairs.

These devices carry into practice mechanically simple structures, which are a guarantee of reliability and easy maintenance.

Due to these arrangements, the sheets are conveyed one by one by the conveyor means, when the ramp is rotated, and have the time to dry during this conveyance during the application of the invention to the collating or storage of paper sheets at the output of an ink printing device.

Due to the rotation opposite to the winding direction, each newly-arrived sheet in the device is found, at the output of the portion of the circuit comprising said ramp, under the preceding sheet. In these conditions, the order of arrival of the sheets is preserved at least at this level, the first sheet arrived being on top of the stack of sheets at the output of the device, and the last arrival being placed at the bottom of this stack.

Moreover, according to the invention, a first of the two ramps has in relation to the other a reverse winding. In the case of two pairs of ramps, the ramps placed on the same side are selected with an identical winding direction.

Because of this arrangement during its conveyance, the sheet undergoes a minimum of tension, and the risk of tearing of the sheet is accordingly minimized. Furthermore, a correct placement of the sheet is guaranteed at the output of the device.

More particularly, concerning the first embodiment, the lateral guiding is performed by the ramps themselves coming laterally into contact with the sheets. The resulting device is of simple construction and compact size, while allowing a storage of properly stacked sheets.

Advantageously, the guide and placement means comprise the interior and upper edges of each of the ramps to ensure the guiding and lateral positioning of the sheets.

The conveyor means may also have a second pair of ramps arranged downstream from said first pair in relation to the arrival movement of the sheets, in order to enhance the support of the sheets during their movement.

The collating or storage of the sheets takes place here on the free end of the ramps, from where they are seized.

In the second preferred embodiment of the invention, the first ramps of each of the two pairs located respectively on the same side have a greater height than that of the second ramps.

This arrangement helps to facilitate the receiving of the sheets. When at the end of its conveyance, the sheet is placed on the upper free end of the ramps, due to the fact that the first ramps of each of the pairs are higher than the second, the sheet arriving on the top of the ramps is driven by gravity and slides toward the side, where it is received.

The receiving of the sheets in a preferred embodiment of this variant can be carried into practice by providing the storage zone with a retaining means arranged laterally to the second and lower ramps.

Preferably, in this embodiment, a retractable abutment is fixed to the interface of the second ramps and of the retaining means. Thus, a prior collating of the sheets is effected on the free ends of the ramps before they slide into the retaining means after the retraction of the abutment, thus helping to preserve the order of arrival of the sheets.

A similar sliding effect, replacing or supplementing the sliding by gravity, can also be obtained by enhancing the friction between the terminal part of the ramp, facing the free end, of the first ramps of each pair, and the sheet, to drive the sheet by friction. Advantageously, this friction enhancement is obtained by increasing the crosssection of said terminal part of the ramp and, in consequence, the surface of the ramp in contact with the sheet. An overhang overlying the first ramps thus prevents the sheet pushed towards the receiving output of the device from moving backwards.

Advantageously, the increase in the cross-section of the terminal parts of the turn of the first ramps may be more substantial by selecting a diameter of the first ramps that is greater than that of the second ramps. Furthermore, in this case the influence of the second ramps is decreased owing to a lesser support of the sheets, thus supplementing the lateral sliding by friction effect by a sliding by gravity effect.

It is to be noted that the two embodiments of the invention discussed above can be combined.

In the preferred embodiment to the rotating means is associated a rotation counter device associated with an electronic control device intended to synchronize the positioning of the ramps in relation to the input of a sheet in the device by transmitting activation and deactivation signals to a motor driving the rotating means and to sheet feed means.

This arrangement serves advantageously to couple the conveyor means with upstream feed means, to prevent jamming of the machine. In addition, this arrangement serves to allow the next sheet to arrive only when the portion of ramp is in an adequate position to receive it.

Advantageously, in this case, said activation and deactivation signals also act on printing means comprising sheet feed means, in the case of treatment of printed sheets, in order to interrupt the printing of the sheets in good time to prevent a printed sheet at the output of the printing means to reach the input of the conveyor device too soon.

In the preferred embodiment the ramps each comprise a base adapted to allow easy mounting and demounting of the ramps on the complementary forms of a portion at least of the associated rotating means.

Because of this arrangement, the maintenance of the device is facilitated and any erroneous handling is avoided.

BRIEF DESCRIPTION OF THE DRAWINGS

The above and other objects and advantages of the invention will be apparent from the following description taken in conjunction with the accompanying drawings, wherein:

FIG. 14 shows a schematic perspective view of another embodiment of a pair of ramps;

FIGS. 14*a* and 14*b* are enlarged schematic views of a detail of FIG. 14, FIG. 15 also illustrates, schematically, in elevation, another variant or a pair or lamps, FIG. 19*a* shows, schematically in elevation, a ramp according to the preferred embodiment of the device of FIG. 3, FIGS. 19*b* and 19*c* are respectively schematic plan and perspective views of FIG. 19*a*, FIGS. 20 and 21 show, in a cross-section and schematically, a feeling device used in the device shown in FIGS. 2 and 3.

DESCRIPTION OF THE PREFERRED EMBODIMENTS

Before the detailed description of the preferred embodiments, a number of terms relating to the invention will first be defined.

First, the terms "ramp" and "helix" will be employed interchangeably to designate the helical ramp in the rest of the description.

In the sense of the present invention, the "helix" shape should be considered not only in its mathematical or geometrical sense, that is to say a curve drawn on a cylinder that is uniformly rotated about its axis by a scribing point moving uniformly parallel to the axis, but also includes all possible variants of a helix, such as, for example, a "polygonal" helix consisting of a succession of line segments inscribed within a perfect or imperfect helix.

Figure 1A:
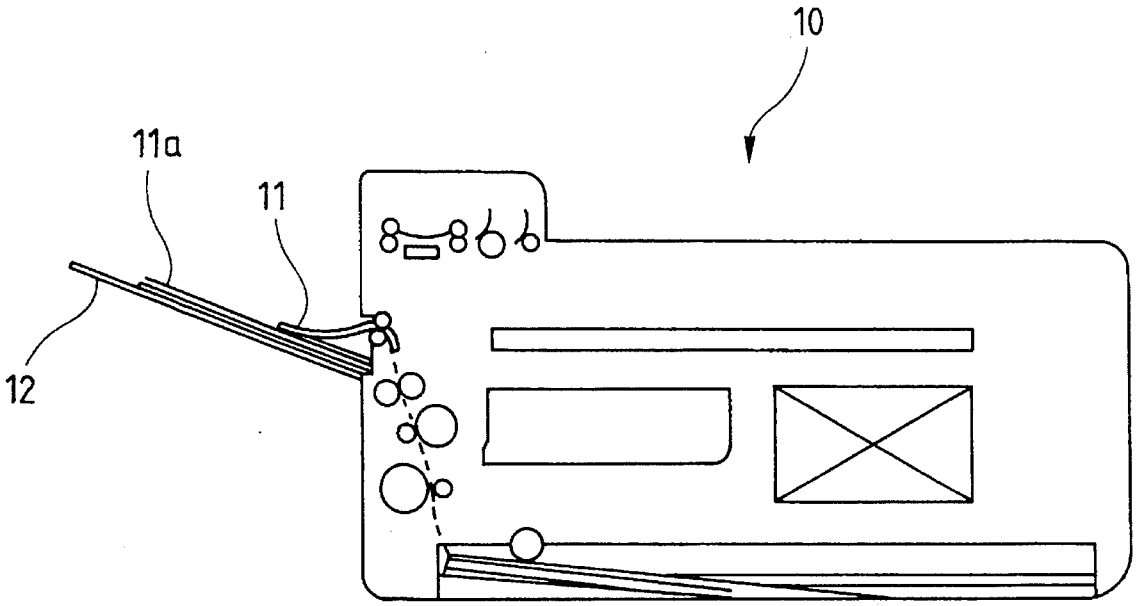
FIG. 1*a* illustrates a device which receives printed sheets, such as a facsimile apparatus, copying apparatus or printer.
Figure 1B:
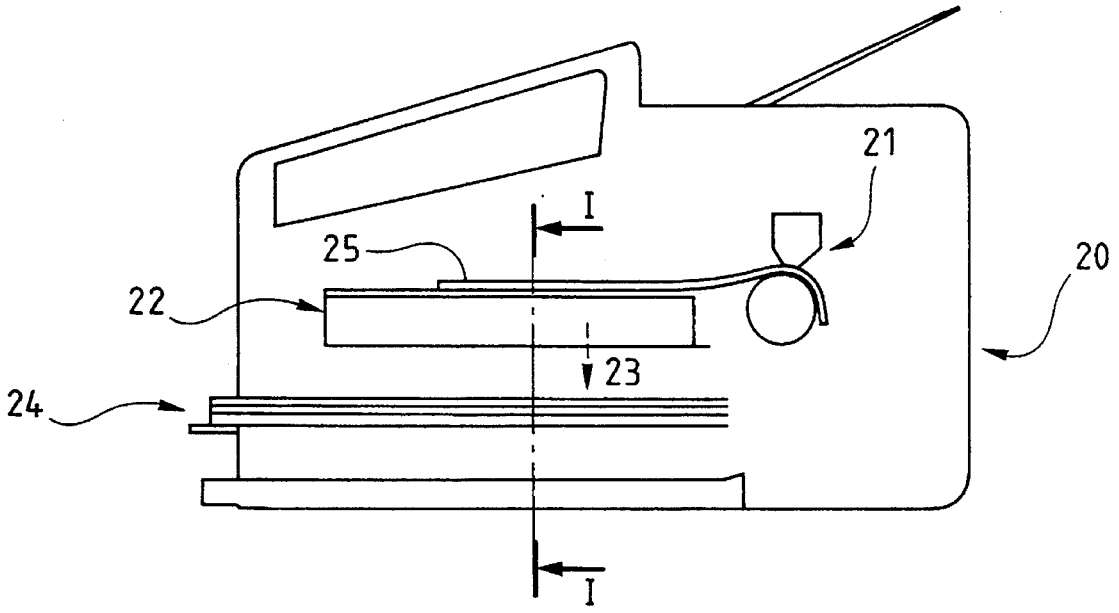
FIGS. 1*b*, 1*c* and 1*d* illustrate various views of a facsimile apparatus
Figure 1C:
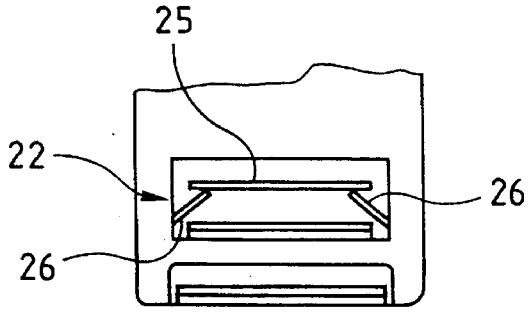
Figure 1D:
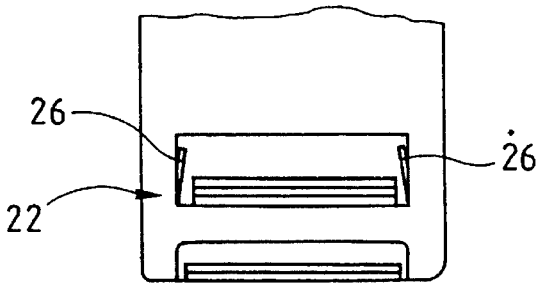
Figure 1E:
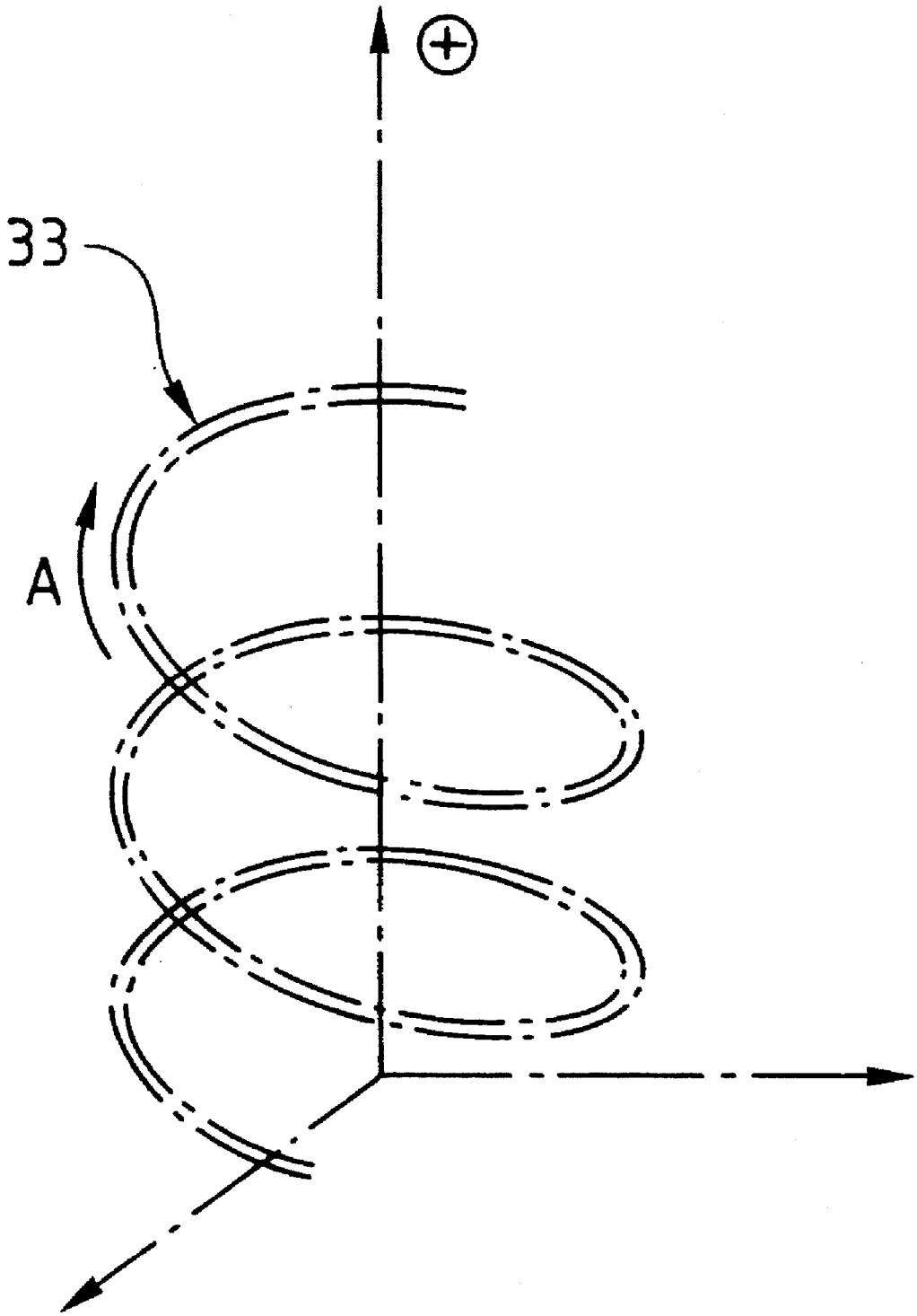
FIG. 1*e* represents schematically a helical ramp, FIG. 2 with partial cutaway view is a schematic perspective view along a first direction, of a first embodiment of a device according to the invention.

As shown schematically in FIG. 1*e*, the winding direction is by convention "leftward" when a point moving along the helix (arrow A) rotates about its axis in the clockwise direction, while its projection on said axis moves in the positive direction of the latter by convention, and when this point is observed from the positive end of this axis.

The winding direction is said to be "rightward" in the opposite case.

The rotation direction of the helix is also seen from the positive end of the axis.

Figure 2:
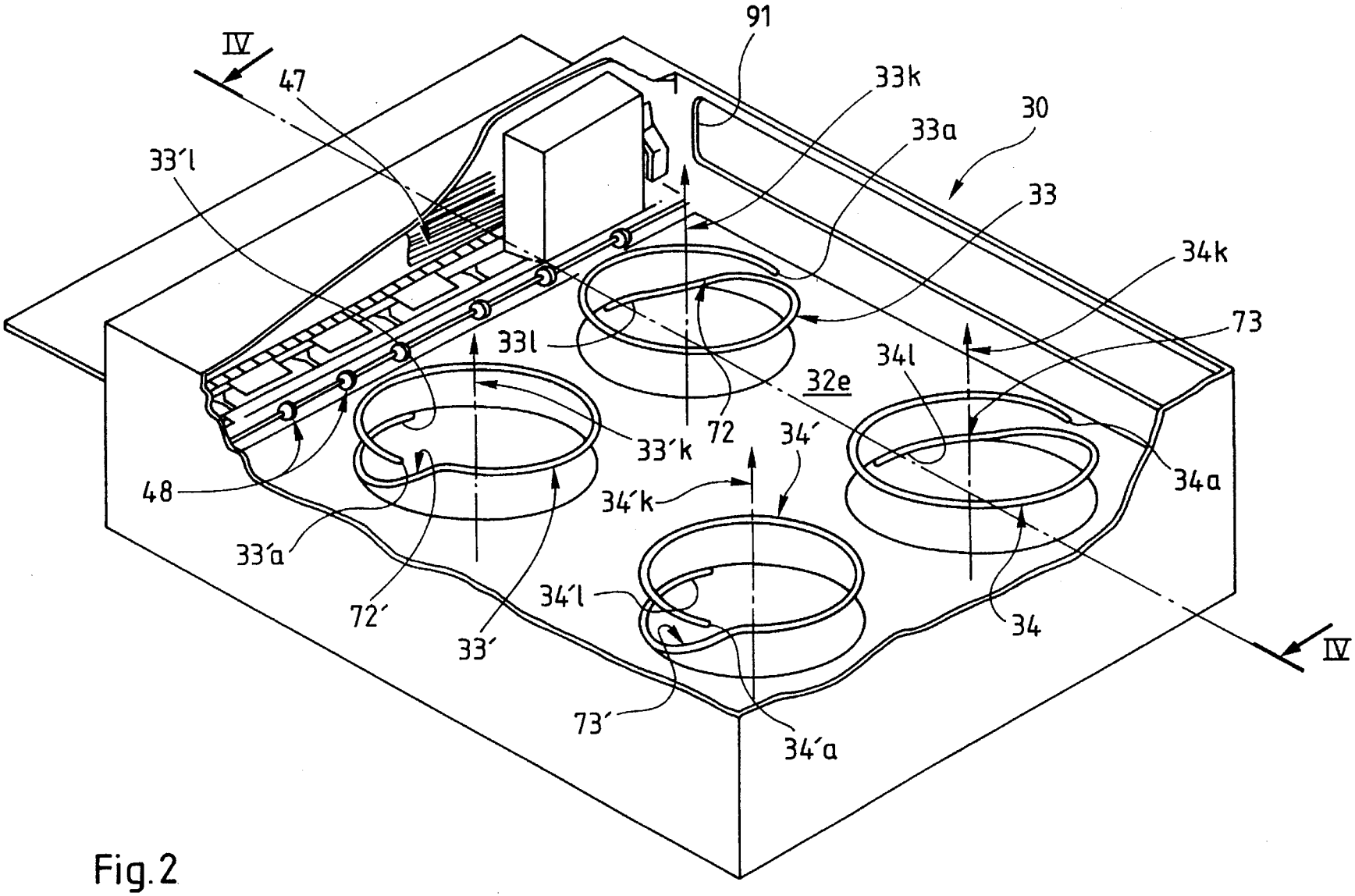
Figure 3:
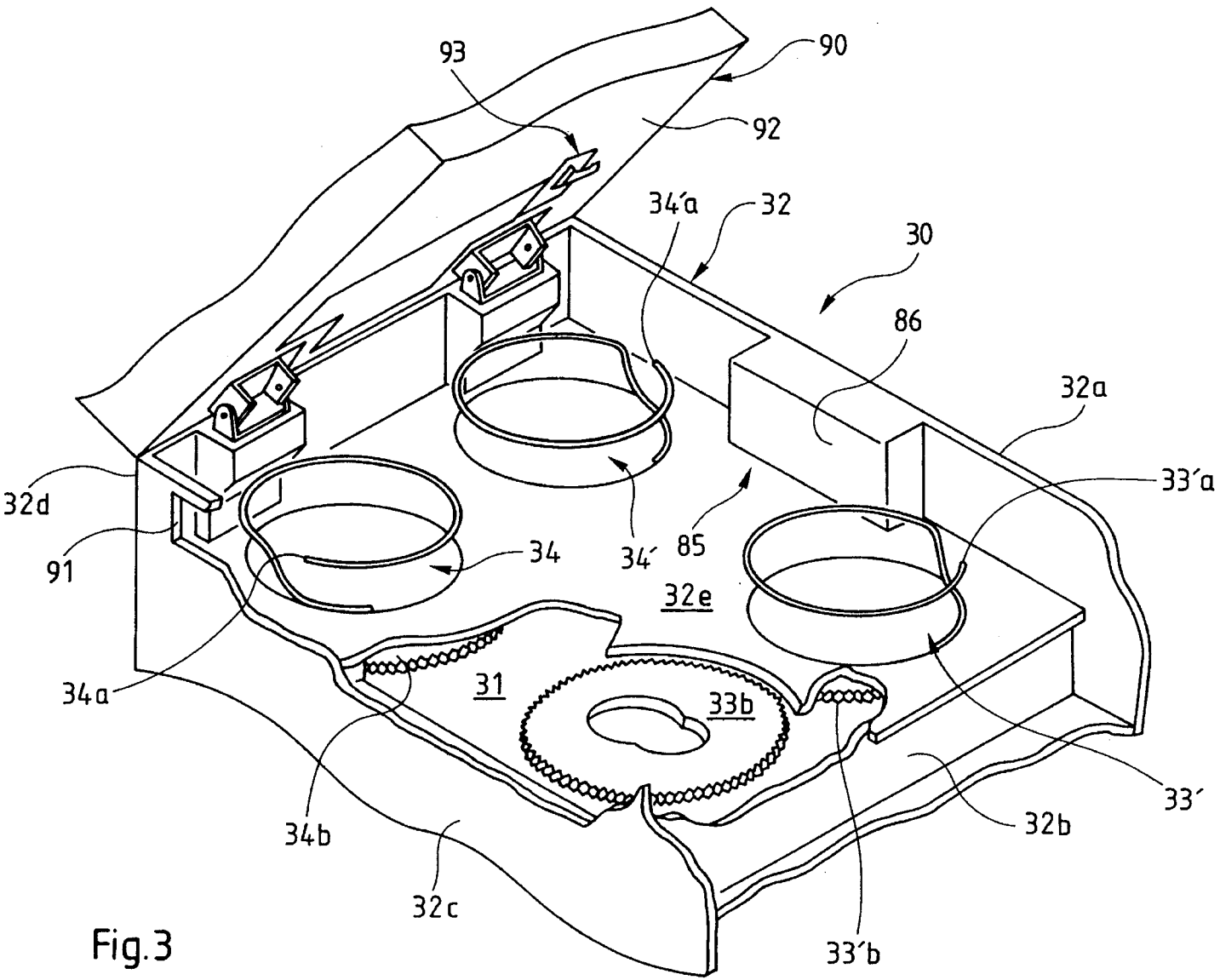
FIG. 3 is a schematic perspective view along a second direction, with partial cutaway view, of the device shown in FIG. 2.

According to the preferred embodiment shown in FIGS. 2 and 3, a storage device 30 according to the invention comprises a metallic support 31 on a frame 32 comprising in particular side walls 32*a*, 32*b*, 32*c*, and 32*d*, and, in addition, a base plate 32*e*. Metallic support 31 is intended to carry the different means constituting this preferred embodiment of the storage device and, more specifically, the rotating-means. The base plate 32*e* separates the mechanical portion from the sheet collating and storage portion. This plate is perforated in order to make the connection between the different components of the device. For a better understanding of the invention, the components that are not indispensable to the understanding of the invention are not shown in FIGS. 2 and 3.

According to the preferred embodiment of the invention described here, the device 30 comprises at least a first pair of helixes.

In the embodiment shown in FIGS. 2 and 3, the device comprises a first pair of helixes 33, 33' and a second pair of helixes 34, 34'. It may be observed in FIGS. 2 and 3 that the helixes shown therein comprise about 1.25 turns. It should be noted that, in other variants, it is possible to use whole turns, which may or may not have fractions, or even fractions of turns only.

Helixes 33, 33', 34, 34' constitute here a portion of the conveyor means.

Helixes 33', 34', are wound rightward, while helixes 33, 34 are wound leftward.

Ramps 33, 33', 34, 34' are made here of steel wire, 5 mm in diameter. The diameter of the helix here is 96 mm, and its height is 25 mm.

It may be observed that the surface of the ramp formed by the steel wire is smooth.

Other materials may be used by those skilled in the art to make the helixes, for example composites etc.

According to this preferred embodiment of the invention, the upper end 33*a* (respectively 33'*a*, 34*a*, 34,*a*) of helixes 33, 33', 34, 34' is free.

Furthermore, each of the helixes 33, 33', 34, 34' is also arranged on a rotating means which rotates it about its axis 33*k*, 33'*k*, 34*k*, 34'*k*, in the opposite direction to its winding. The rotating means are visible in FIG. 3, and consist in this case of rotation gears 33*b* (respectively 33'*b*, 34*b*, 34'*b*) supporting the bases of the concerned turns. In FIG. 3, gear 33*b* is completely visible, turn 33 not being shown, while rotation gears 33'*b*, 34*b* of helixes 33', 34 are partially visible, the gear associated with helix 34' not being shown in this figure.

Means, such as a motor, are provided to rotate the gears 33*b*, 33'*b*, 34*b*, 34'*b*. It may be observed here that the gears associated with the first pair of helixes 33, 33' mesh in such a way that, by definition, the helixes of the first pair 33, 33' have an inverse rotatory movement. The same applies to helixes 34, 34,.

Furthermore, the helixes of each pair 33, 33' and 34, 34' are wound in opposite directions, while the helixes disposed on the same side, referred to below as the first and second helixes (33', 34' on the one hand, 33, 34 on the other) are wound in the same direction.

It may also be observed that this arrangement has approximately parallel rotation axes 33*k*, 33'*k*, 34*k*, 34'*k*, according to this preferred embodiment of the invention.

Figures 6A, 6B, 7A, 7B, 8A, 8B, 9A, 9B:
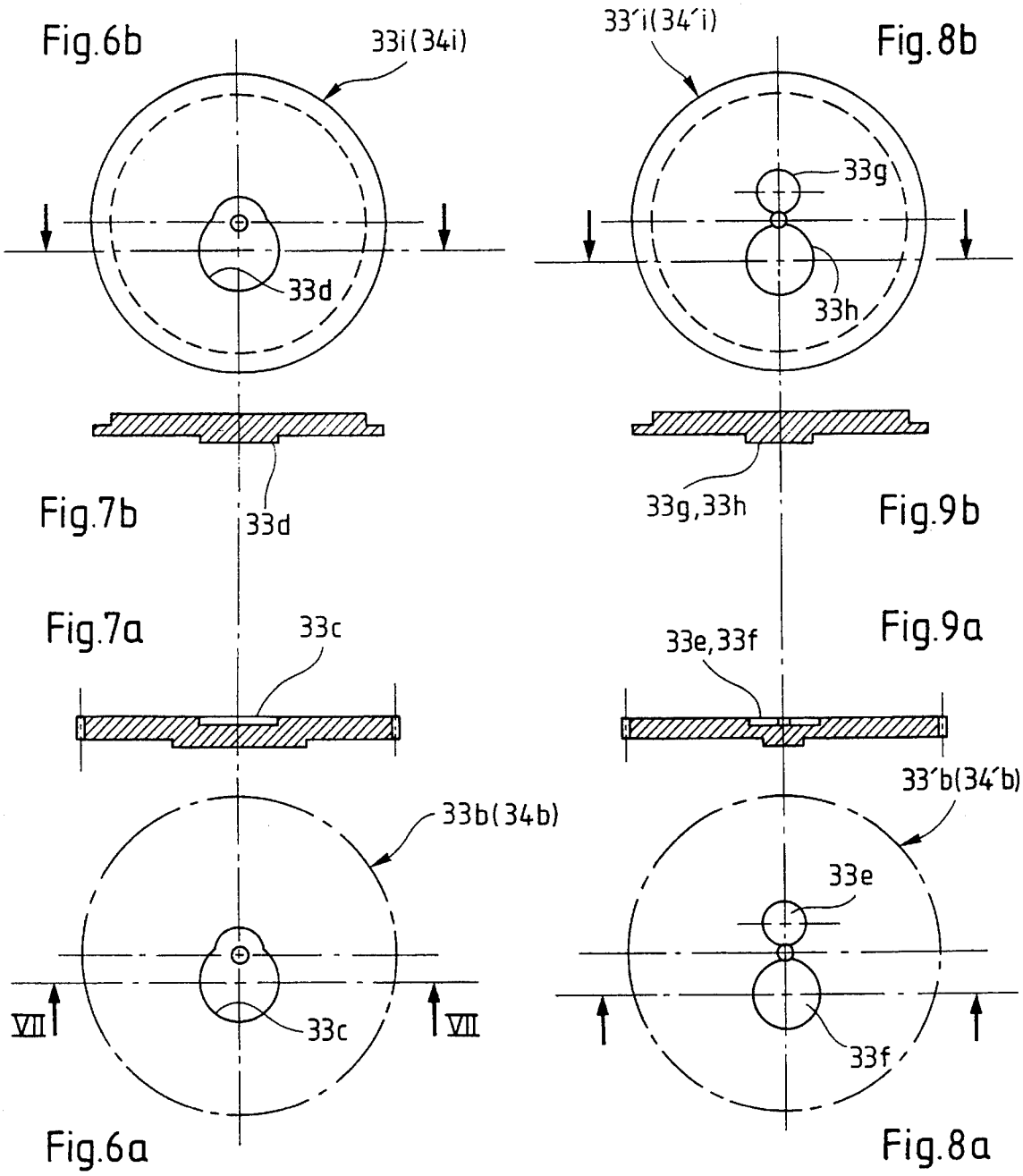
FIG. 6*a* is a schematic plan view of a gear used in the device in FIG. 3.
FIG. 7*a* is a schematic sectional view of this gear along line VII—VII in FIG. 6*a*, FIGS. 6*b* and 7*b* are similar schematic views of a base corresponding to the gear shown in FIGS. 6*a* and 7*a*, FIGS. 8*a*, 8*b*, 9*a* and 9*b* are similar schematic views to FIGS. 6*a*, 6*b*, 7*a* and 7*b* with respect to another base/gear assembly.

Each helix is made integral with the gear rotating it by means of a device that is described by reference to FIGS. 6*a*, 6*b*, 7*a* and 7*b*. FIGS. 6*a* and 7*a* illustrate gears 33*b*, 34*b* that are identical because they are disposed on the same side. It may be observed, and this is in fact also visible in FIG. 3, that gears 33*b*, 34*b* comprise an enlightening recess 33c roughly in the shape of a figure eight. Base 33*i* (34*i*) to which helix 33 (34) is fixed is shown in a plan view in FIG. 6*b*, and in a diametral cross-section in FIG. 7*b*. It may be observed that base 33*i* has a significantly smaller diameter than the gear, and that it comprises a nesting projection 33*d* of a shape complementary to recess 33*c*.

The relative arrangement of the ramps 33', 34' and the gears 33'*b*, 34'*b* on the second side is shown in FIGS. 8*a*, 8*b*, 9*a* and 9*b*. The nesting is achieved therein by means of two circular recesses 33*e*, 33*f*, and projections 33*g*, 33*h* corresponding to them on base 33'*i* (respectively 34'*i*).

It may be observed that, advantageously, the shape of the nesting means is asymmetrical, so that the bases and 33'*i* (respectively 34*i* and 34'*i*) are always in the same relative direction with respect to the concerned gears 33*b*, 33'*b* (respectively 34*b*, 34'*b*). Furthermore, they cannot be positioned one in place of another, and this serves to prevent any accidental inversion of the ramps during maintenance operations.

Such an arrangement makes it possible inter alia to orient the ramps 33, 33', 34, 34' adequately in relation to each other, and to position correctly the predetermined ramp portions 331, 331', 341, 34'1 on which the sheets to be conveyed are received. See below, in particular description of FIGS. 4*a* and 4*b*.

The bases are, for example made of plastic, the same material as the gears.

Ramps 33, 34, 33', 34' are adjusted on their base, the diameter of the bases being slightly larger than that of the ramps. Each helical ramp is therefore tightened on its base.

Figure 10:
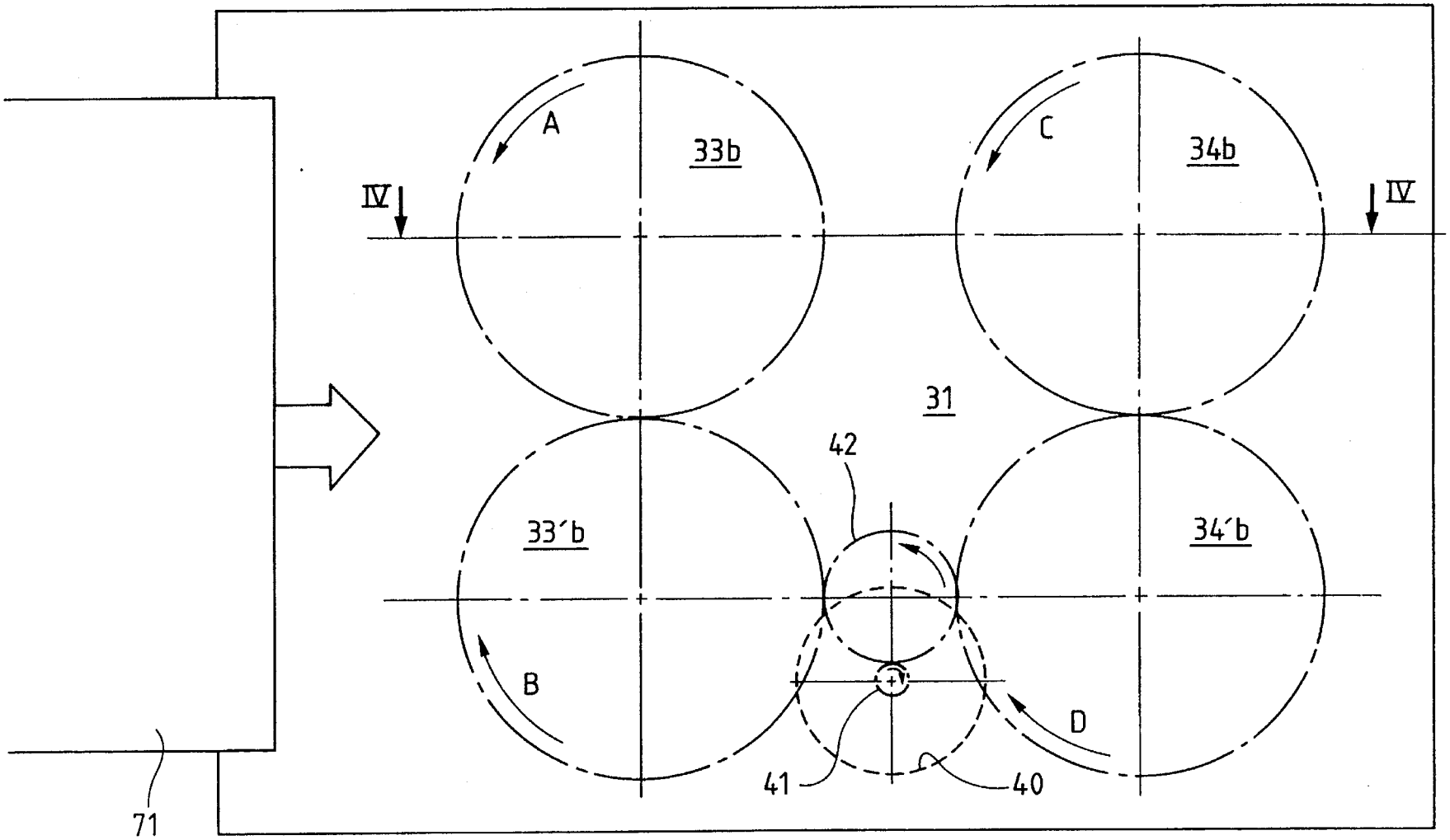
FIG. 10 is a schematic plan view illustrating the rotation drive of the gears associated with the ramps of the device in FIG. 3.

FIG. 10 shows schematically the rotation drive of gears 33*b*, 34*b*, 33'*b*, 34'*b*.

In this figure, these gears are shown by a dotted and dashed line. A motor is provided, shown schematically under reference 40, whose output shaft is connected to a pinion gear 41 meshing with a main pinion 42, itself meshing with gears 33'*b*, 34'*b*, so that these gears are rotated in the same direction (arrow B and D). As explained above (FIG. 3), gears 33'*b* and 34'*b* mesh respectively with gears 33*b* and 34*b*.

Thus gears 33*b* and 34*b* are rotated in the same direction (arrows A and C), and in the opposite direction to gears 33'*b* and 34'*b* (arrows B and D).

FIG. 10 also shows the drive principle of the rotating means, and, in particular, of the support gears 33*b*, 33'*b*, 34*b*, 34'*b* from a motor 40. No further description will be provided of the arrangement shown schematically in FIG. 10, since the details of this arrangement will be known to those skilled in the art.

However, it may be noted that, in this embodiment, motor 40 is an electric motor with a rotation speed of 275 revolutions per minute, while the arrangement of the gears shown in FIG. 10 enables the helixes to rotate at a speed of about 20 revolutions per minute. The output pinion 41 has 17 teeth here, pinion 42 has 86 teeth, the support gears 33*b*, 33'*b*, 34*b*, 34'*b* have 234 teeth, and the module is 0.5.

According to the invention, the device comprises a circuit for conveying sheets to be stored.

The sheet conveyor circuit 71 is the one going from the input of the device, corresponding in this case to the output of the ejecting means of a printer (here of the type marketed by the Canon company under reference BJ 10), up to the output of the device, which is here the free end (33*a*, 33'*a*, 34*a*, 34'*a*) of the ramps. In other embodiments, a storage zone may be provided comprising a receiving tray arranged laterally of two free ends of helixes, or possibly a receiving slot (see, for example, the description of FIG. 22).

In FIG. 2, a portion of said sheet ejecting means is shown under reference 47. It may be observed that these means are partially arranged here inside the housing 32, that is to say between the entry side 32*b* and the turns 33, 33' of the input pair.

These ejecting means 47 constitute here an embodiment of "feed means" in the sense of the present invention. These ejecting means 47 and the BJ 10 printer which comprises them, are not described in detail herein. A more complete description of this printer and of the ejecting means can be found in Patent EP-0,418,815 filed by the Canon company.

Figure 4:
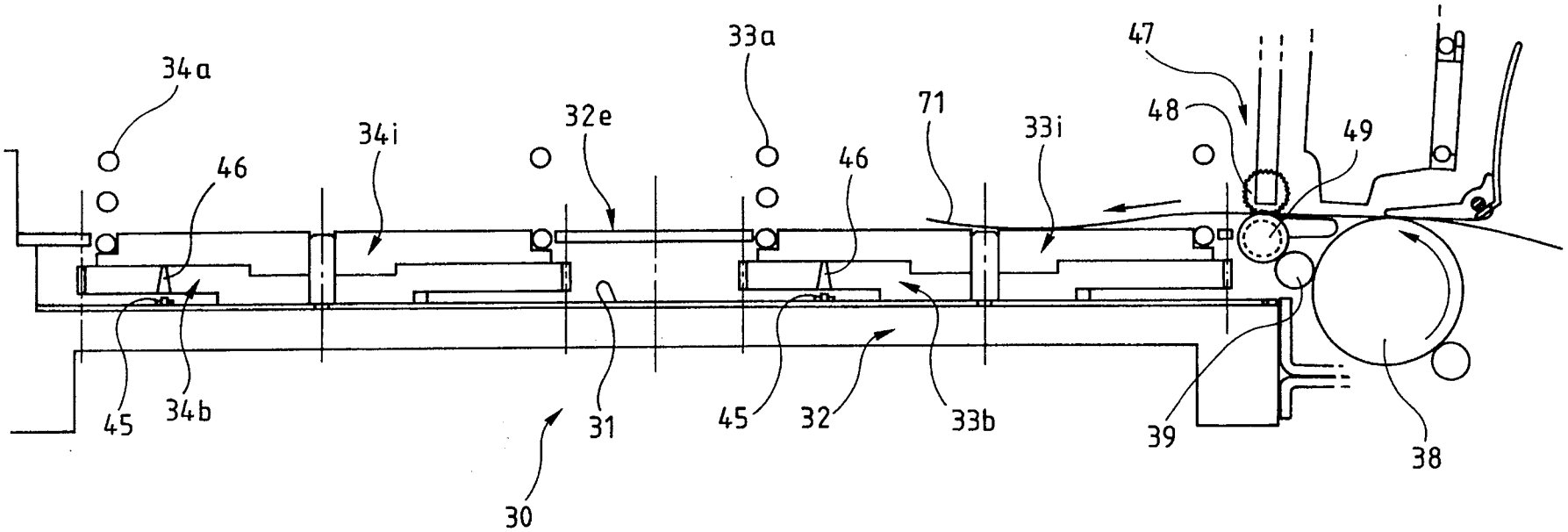
FIG. 4 is a schematic longitudinal cross-section view of the device in FIG. 2 along section plane IV—IV shown in this figure.

However, it may be noted that, in the embodiment chosen and shown in the figures, the ejecting means 47, shown in a transverse cross-section in FIG. 4, comprise in particular a plurality of toothed wheels 48 driven by an unloading roller 49 intended to guide the entering sheet to position it on a predetermined portion 331, 33'1 and between the interior and upper edges of each of the ramps of the first pair of ramps 33, 33' forming the input pair. Roller 49 is itself rotated by a sheet feed roller 38 via a transmission roller 39.

In this embodiment, the device being combined with a BJ 10 printer, a synchronization, which is described below, is necessary between the ejecting means of the printer and the position of the ramps.

FIG. 4 also schematically shows a detector responsive to the presence of the bases. It is composed of elements known to those skilled in the art (such as light-emitting diodes, photo transistors, and reflecting portions). The emitting/detecting portion of detector 45 is placed under a cavity 46 of each of the gears on the metallic support 31, while the reflecting portion is arranged under each of the corresponding bases.

The presence of the bases can thus be checked through cavity 46 after the gear has been placed in an adequate position during the operation of the device according to the invention.

Figure 12:
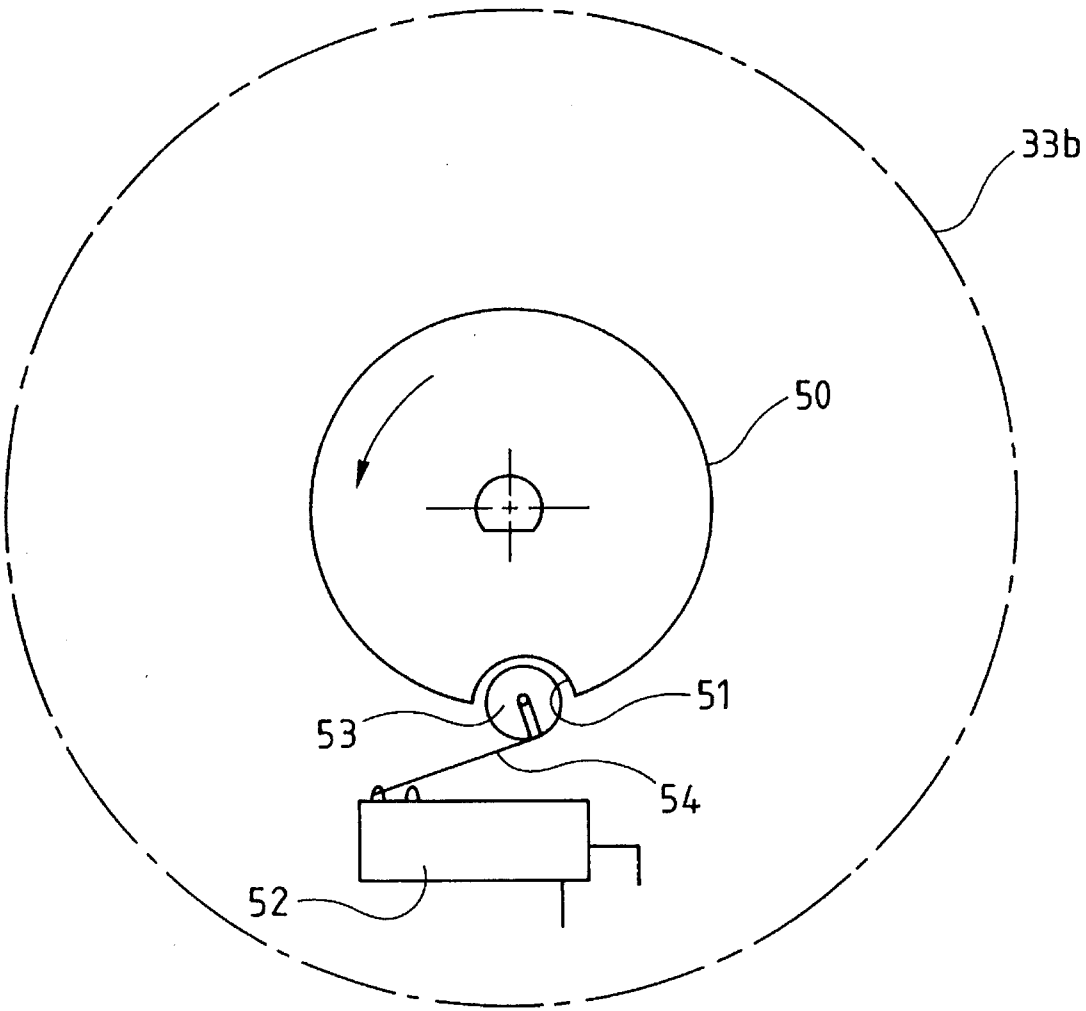
FIG. 12 is a schematic underside view of one of the rotation gears of the device of FIGS. 2 and 3, and illustrates the roller switch device associated with this gear.

FIG. 12 schematically illustrates one, 33*b*, of the gears from below. Associated with this gear is a portion of a rotation counter device comprising a circular protuberance 50 aligned with the axis of gear 33*b*. Protuberance 50 has a concavity 51. Frame 32 of the machine has a roller switch device 52–54 of a conventional structure comprising a trip roller 53 acting on a counting lever 54 associated with a switch 52.

To prevent a sheet from being damaged when it reaches the free ends of the helixes, it may be provided in the preferred embodiment that the free ends 33*a*, 33'*a*, 34*a*, 34'*a* of the helixes 33, 33', 34, 34' comprise a circular portion 33*m*, 33'*m*, 34*m*, 34'*m* inscribed within a horizontal plane as shown schematically for a helix 33 in FIGS. 19*a*, 19*b* and 19*c*. This arrangement also reduces the undesirable movements of the sheet at the output of the device according to the invention.

Figure 20:
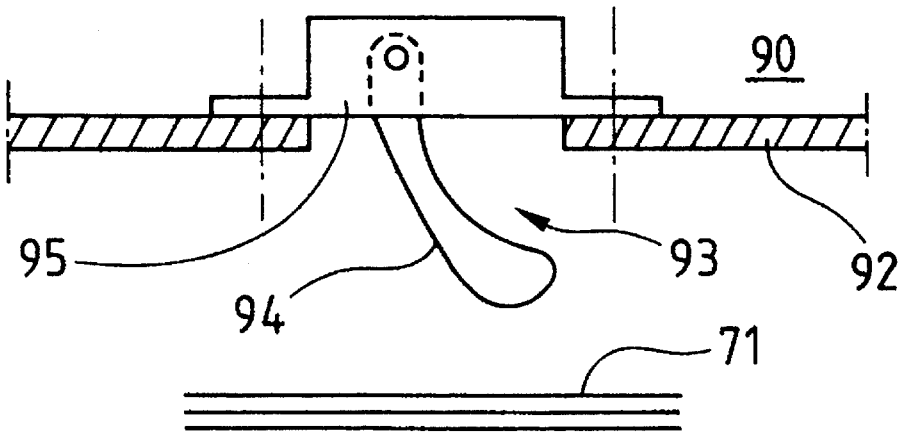
Figure 21:
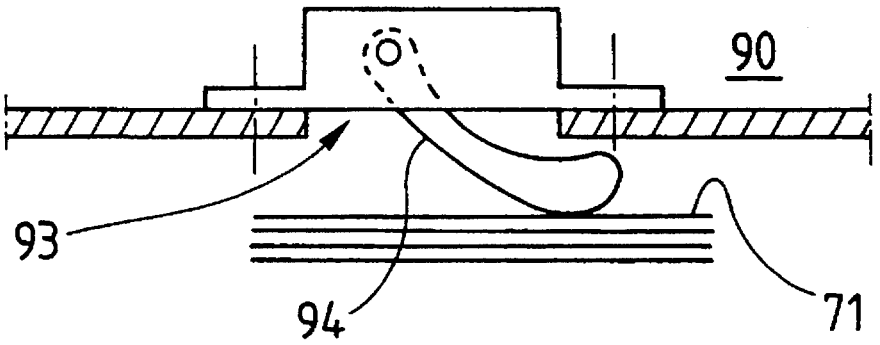

We shall now describe by reference to FIGS. 20 and 21 a jamming control device advantageously carried into practice in the preferred embodiment shown in FIGS. 2 and 3.

In the embodiment in FIG. 3, a hinged cover 90 may be provided capable of closing the frame forming housing 32. In this case, the user seizes the sheets conveyed at the output through an extraction slot 91 (see also FIG. 2, in which cover 90 is not shown for purposes of simplification).

When the cover 90 is closed, there is a possibility of sheets jamming at the output of the device, between the tops of the helixes 33, 33' and 34, 34' and the lower side 92 of cover 90. The arrangement described here is intended to prevent this jamming.

To do this, an overflow feeling device 93 is provided comprising a feeling component 94 connected to an electric contact which switches a circuit when the feeler is in the high position (FIG. 21).

The feeler is lodged in a recess 95 arranged in the underneath side 92 of the cover 90, as shown in FIG. 3. When the stack of sheets at the output exceeds a predetermined thickness (3 cm in this embodiment), the increase in thickness raises the feeling component 94 (FIGS. 3 and 21), triggering the transmission of an interruption signal to the logic of the device.

Figure 11:
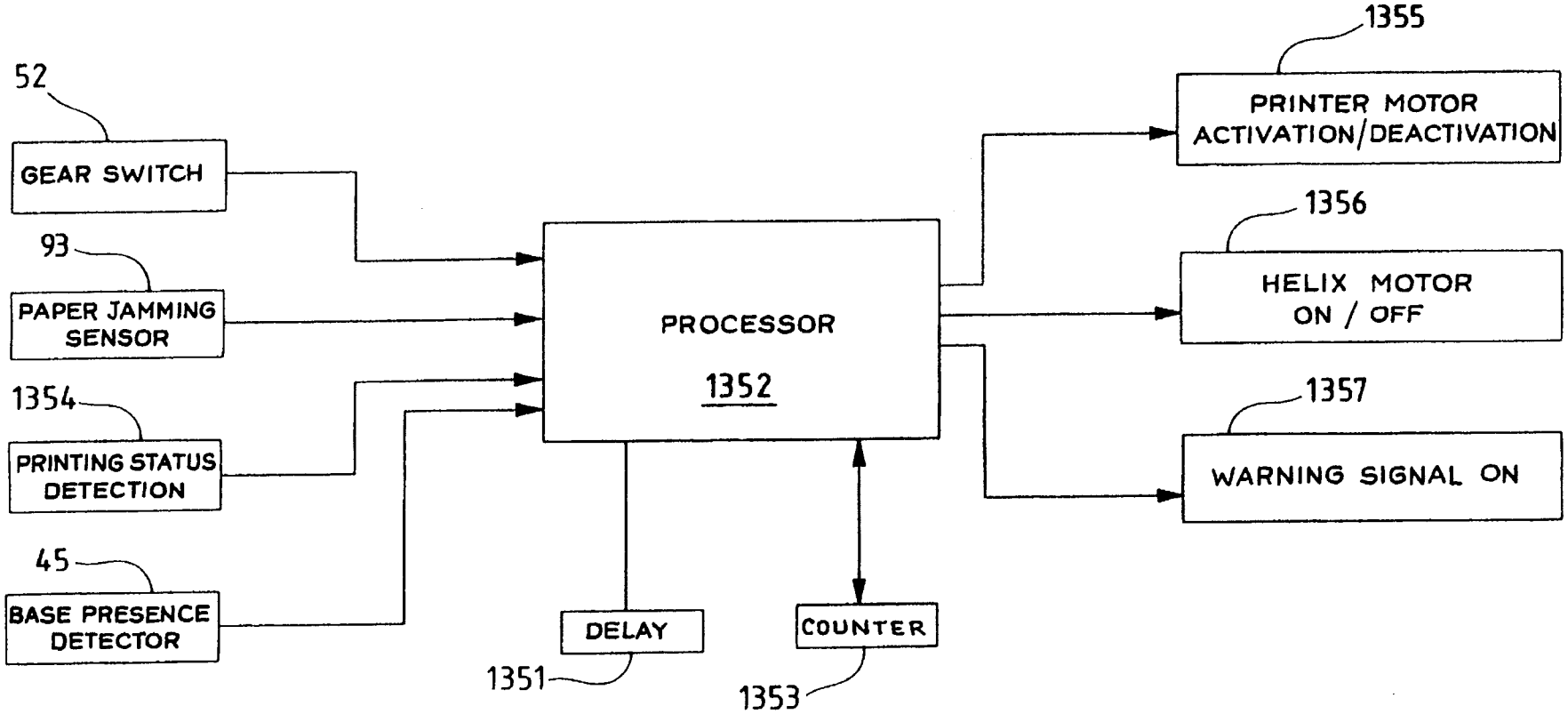
FIG. 11 is a simplified diagram of the electronic control device used in the device of FIG. 3.

The operation of the machine is governed by an electronic control device such as the one shown schematically in FIG. 11. This comprises a processor 1352 programmed according to the flow chart in FIG. 13 described below. It is connected to the gear switch 52, the feeling device 93, and to a detector responsive to the presence of bases 45. It is also connected to a printing status detector 1354 which forms part of the printing means, and which is not described in further detail, since these detectors are of a type known to those skilled in the art.

These four control elements 52, 93, 1354 and 45 supply to processor 1352 data on the status of the device according to the invention, and of the printing means associated with it in the preferred embodiment. Based on these data, and on the status of a counter 1353 of the rotation counter device, this processor controls, according to the flow chart in FIG. 13, a delay generator 1351, an activation and deactivation actuator 1355 of the printing means, an actuator 1356 for switching the motor on and off, counter 1353 and an actuator 1357 that triggers a warning signal. These actuators consist of conventional electronic switches.

The operation of the storage device described by reference to FIGS. 2 to 12 will now be described.

The BJ 10 ink-jet printer is of the lateral sheet ejection type. It is placed against the entry side 32*b*. The printer may be of any type, and, insofar as the sheets are ejected as described above at a speed of about 24 mm per second, it is suitable for the operation of the preferred embodiment of the storage device according to the invention.

Sheet 71 is ejected roughly perpendicular to the axes of the ramps.

Figure 4A:
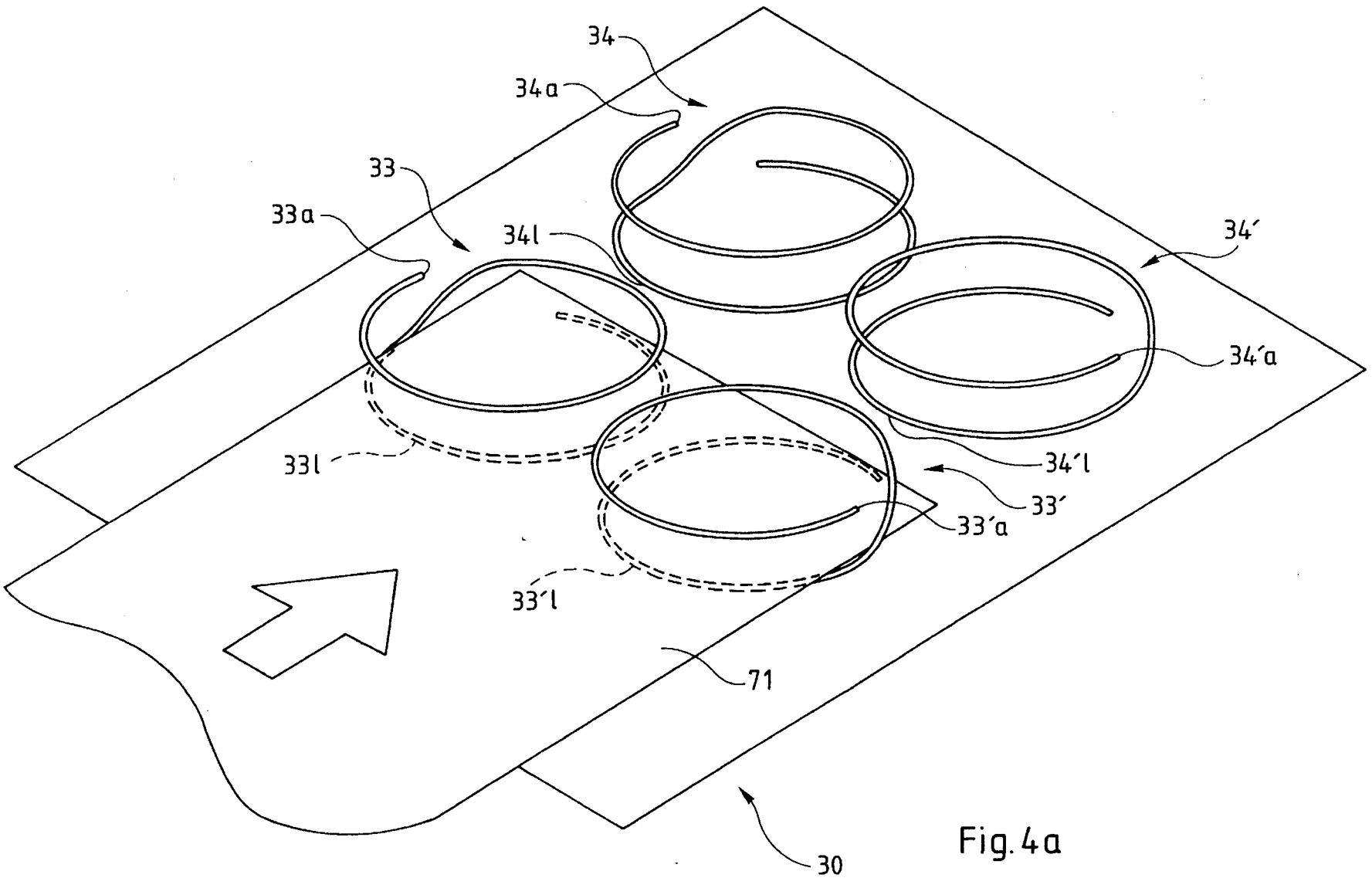
FIGS. 4*a* to 4*c* are schematic views corresponding to FIG. 4, illustrating the conveyance of a sheet in a simplified manner.

It is positioned on a predetermined portion of the base of each ramp of the pair of ramps. These portions, which are also called "receiving" portions, are shown in FIG. 4*a* for the input helix pair 33, 33' in broken lines under references 331, 33'1. It should be observed in fact that each predetermined portion of ramp must be placed in an acceptable position for receiving the sheet so as to avoid stopping it as it travels across the turn or the fraction of turn.

The same applies for the positioning of sheet 71 on the predetermined portions 341, 34'1 of the ramps of the second pair of ramps 34, 34' arranged downstream.

Figure 13:
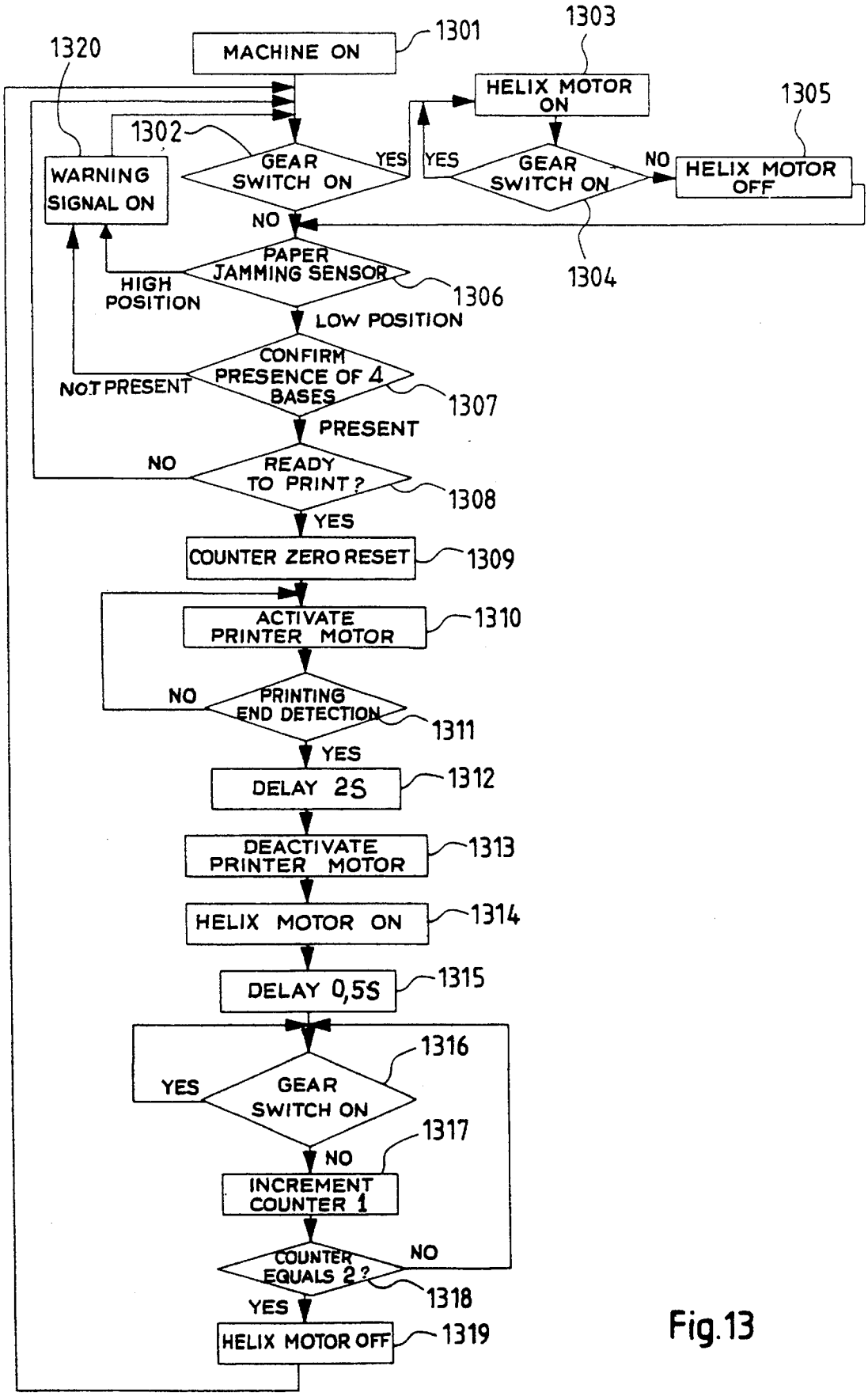
FIG. 13 is an operating flow chart of the machine shown in the FIGS. 2 and 3.

The flow chart in FIG. 13 helps to understand the operation of the machine.

The switching on of the combination consisting of the BJ 10 printer and the device is symbolized by box 1301. A first test (box 1302) is performed downstream. This test is intended to determine whether the gear switch 52 is in the closed position or the open position (i.e. the one shown in FIG. 12, in which roller 53 is nested in concavity 51, in the case of the open position). In the case of a positive response, i.e. in the closed position, this means that the ramp is not in an acceptable initial position for receiving a sheet. Motor 40 is then switched on (box 1303) so that the ramps are rotated. In box 1304, a similar test to test 1302 is performed, and, as long as the trip roller 53 is not nested in concavity 51, motor 40 remains in operation. When test 1304 is negative, i.e. roller 53 is in concavity 51, the motor is switched off (box 1305). The program is then positioned downstream of test 1302.

Another test is performed (box 1306) to determine whether or not the paper is jammed. In this respect, a check is made of the position of the feeling device 93 (see FIG. 20). In the case of a high position of feeler 94 (FIG. 21), a warning signal is triggered (box 1320) by actuator 1357. It may be noted that the program is repositioned upstream from test 1302, so that the machine is stopped until an operator releases it by removing the sheets present at the output. If test 1306 is positive, i.e. feeler 94 is in the low position shown in FIG. 20, it is checked by the test of box 1307 whether the four bases (33*i*, 34*i*, 33'*i*, 34'*i*) with their corresponding ramps (33, 34, 33', 34,) are actually present on their corresponding gears (33*b*, 34*b*, 33'*b*, 34'*b*) before the device is switched on. This test is performed by means of the detector 45 shown in FIG. 4.

If the bases are present, the system proceeds to the next test (box 1308). If not, a warning signal is triggered (box 1320) to call the user to put them back in place. It is then checked in test 1308 whether the BJ 10 printer is ready to print. In the case of a negative response, the program is repositioned upstream from test 1302. In fact, it is important, assuming that the printer is not ready to print, for any reason whatsoever, to check again whether the device at switch 52 is in the position in which roller 53 is nesting in cavity 51 or not. A user may have proceeded in the meantime to remove and to reposition one or more ramps, in which case the overall device must again be reinitialized by means of the loop consisting of boxes 1302 to 1305.

If test 1308 is positive, i.e. the printer is ready to print, counter 1353 is reset to zero (box 1309) by processor 1352.

Printing is then initiated (box 1310) by actuator 1355 and, as long as the end of printing is not detected at the printer (box 1311) by the printing status detector 1354, the program remains connected upstream from box 1310. When a printing end signal is detected at the printer (through detector 1354), test 1311 is positive. The motor of the printer is deactivated (box 1313) by actuator 1355 after a delay of, for example, 2 s (box 1312). This delay is generated by a delay generator 1351 connected to processor 1352. This delay of 2 s enables the sheet to be ejected completely.

Figure 4B:
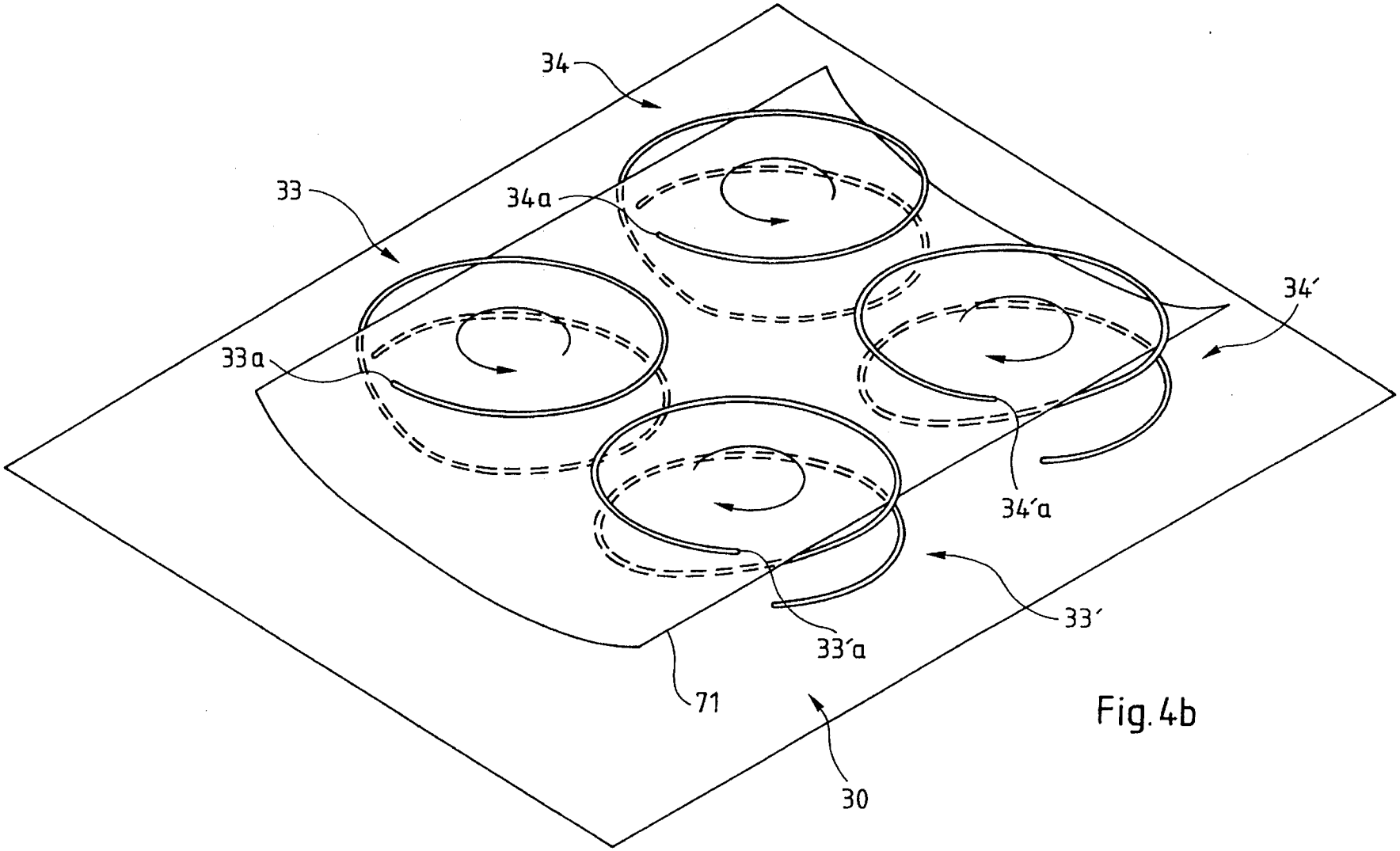
Figures 5, 5A:
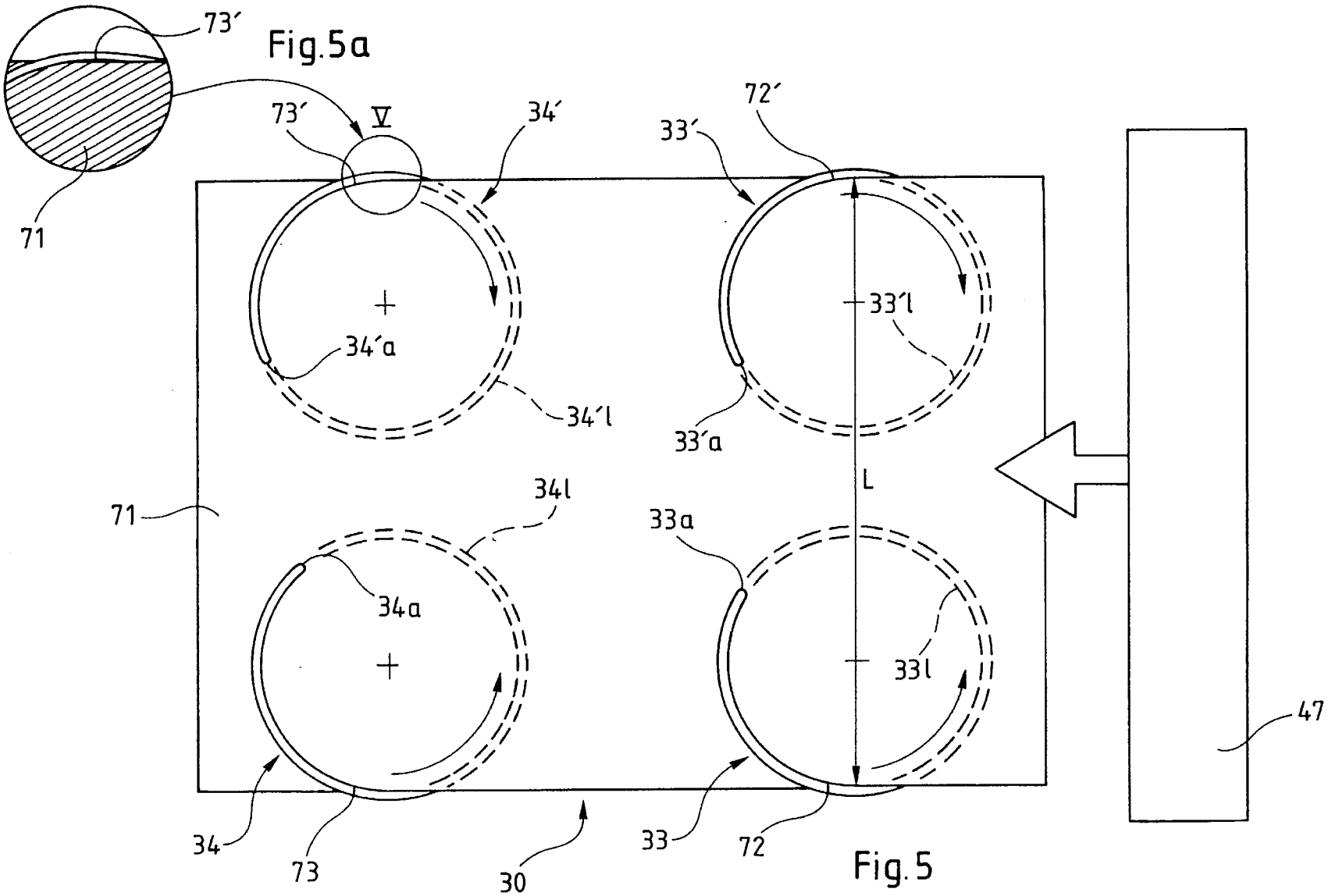
FIG. 5 is a schematic plan view of the device shown in FIGS. 2 and 3.
FIG. 5*a* is an enlarged schematic view of the insert V in FIG. 5.

The loop comprising the tests and program steps 1302 to 1305 serves to make sure that the ramps are positioned by leaving a predetermined portion of the base of the ramp facing the output of the BJ 10 printer. Sheet 71 is guided by the plurality of toothed wheels 48 and the unloading roller 49 of the guide and placement means 47 which are hence represented here by the output of this printer, so that sheet 71 first penetrates on the predetermined portion 331, 33'1 of the base of each helical ramp 33, 33' of the first pair (FIG. 4*a*), and then on that of the predetermined portion of the base 341, 34'1 of each helix 34, 34' of the second pair (FIGS. 4*b* and 5). Motor 40 of the conveyor device is then activated (box 1314) by actuator 1356.

After a delay of 0.5 s (box 1315) generated by the delay generator 1351, a test 1316 of the position of the ramp is performed. The delay of 0.5 s is necessary to enable motor 40 to effectively rotate the helical ramps, and for this rotation to be able to be detected. Test 1316 serves to proceed with the counting of the rotations made by the helical ramps. In fact, as described by reference to FIG. 12, during rotation, roller 53 is not nested in concavity 51, so that switch 52 is closed. At each complete turn, roller 53 is nested in concavity 51, so that switch 52 sends a signal to processor 1352, and so that counter 1353 is incremented (box 1317).

A test is then performed (box 1318) to determine whether the content of counter 1353 is equal to two or not. If not, the program is reconnected upstream from test 1316. If the response is positive, processor 1352 switches off motor 40 (box 1319).

In fact, when the motor is activated it rotates the helixes at a rotation speed of about 20 revolutions per minute. After a rotation of 1.25 turns of the helixes (in this case each helix has 1.25 turns), the sheet reaches the free end 33*a*, 33'*a*, 34*a*, 34'*a* of the helixes (FIG. 4*c*).

Thus, in order to reposition the turns in the position for receiving the next sheet, the helixes must complete the second turn initiated. When, after the second pulse from the counting lever 54, processor 1352 detects the end of the second turn, processor 1352 then switches off the motor (boxes 1318 and 1319).

The program is then reconnected upstream from box 1301 and the second sheet can then be ejected by the printer. The same process serves to convey it to the free end of helixes 33, 33,' 34, 34'.

Figure 4C:
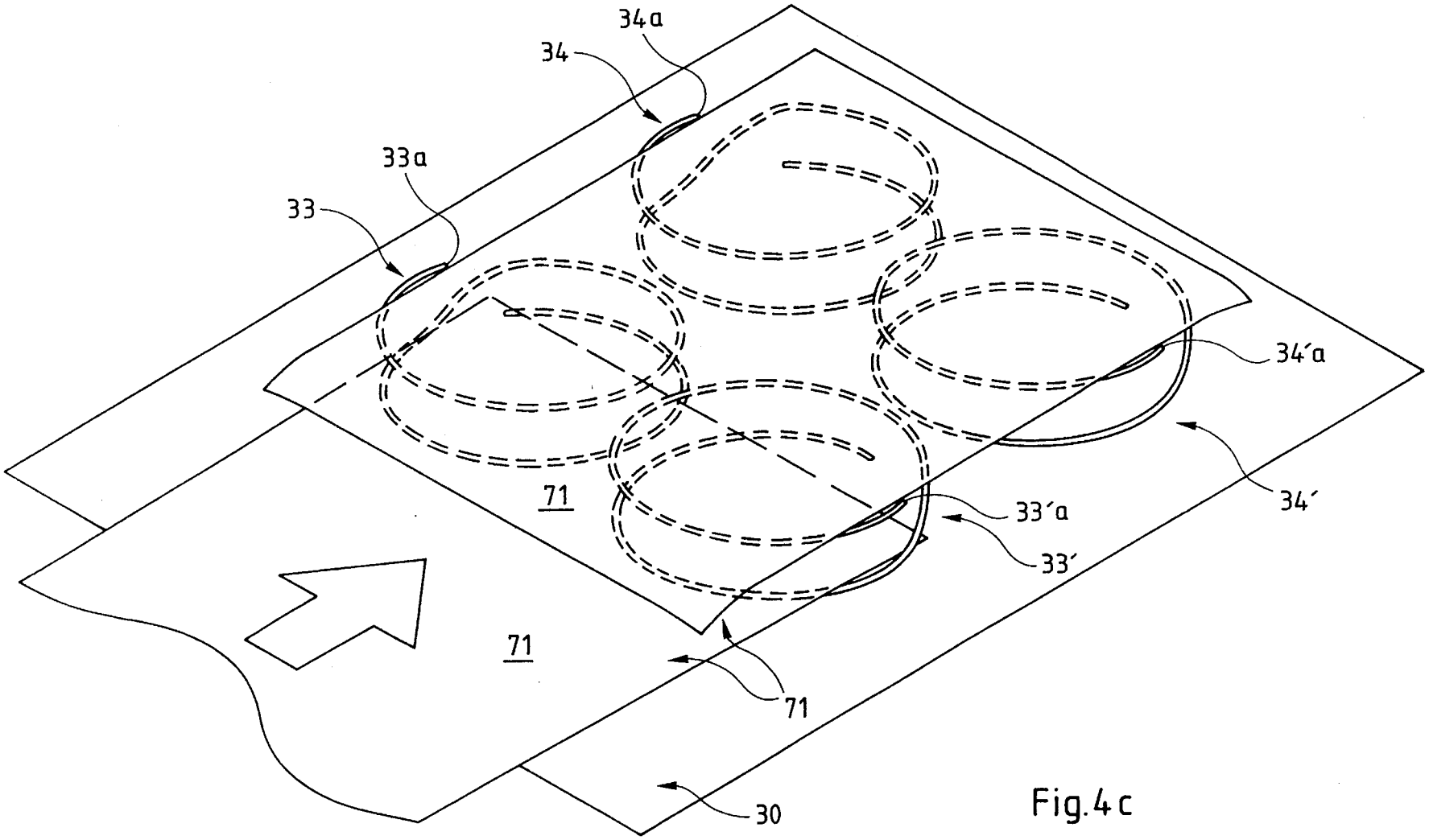

It may be observed that the first sheet in no way prevents the helixes from rotating, whereas this rotation serves to convey the second sheet under the first, so that the sheets disposed at the output of the device (above the helixes) preserve the same order in which they reached the input of the device (FIG. 4*c*).

Furthermore, during the conveying time, the sheet conveyed has the time to dry sufficiently to avoid smudging.

Furthermore, in the arrangement described here, the printed part of sheet 71 is never in contact with the helixes.

It may be observed that this configuration accordingly overcomes at least two of the drawbacks of the prior art recalled in the preamble to the present application.

Moreover, in the device according to the invention, the sheet is guided laterally by helixes 33, 33', 34, 34' during its upward movement, thus allowing a storage of properly stacked sheets. In fact, as shown in the enlargement in FIG. 5*a*, which concerns a detail of FIG. 5 which shows the plan view of the device according to the invention, the edges of sheet 71 are always maintained during the upward movement by the interior and upper edges 72, 72', 73, 73' of ramps 33, 33', 34, 34'. The edges 72, 72', 73, 73' also constitute here an embodiment of "guide and placement means" whose functions are to position sheet 71 laterally in the turns (see FIG. 5*a* where an edge 73' comes into contact with sheet 71, making it possible here to position it laterally to the helix concerned, and the same observations can be made concerning the edges of the other ramps), and to guide sheet 71 during its conveyance by the helical ramps.

Furthermore, it may be recalled that the feed means, here the ejecting means 47, participate in the placement of sheet 71 on the portion of base of the helical ramps by "propelling" the sheet into the free space of the turns.

As a variant of the embodiment described here, and to achieve better lateral guidance, a gap L can be selected between sides 72, 72' and 73, 73' (see FIG. 5) of each of the pairs of helixes 33, 33' and 34, 34' about 1 mm greater than the width 1 of sheet 71.

Figure 18:
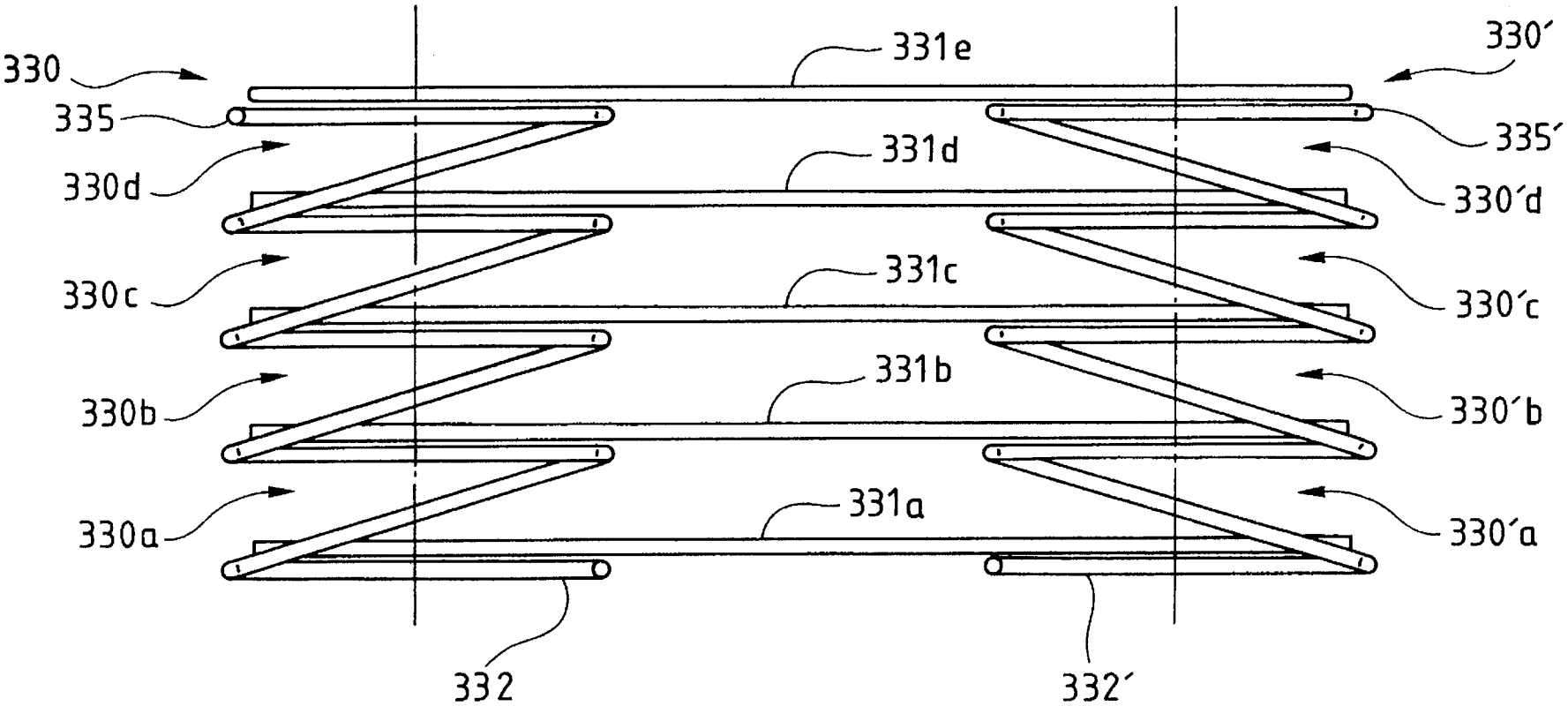
FIG. 18 illustrates, schematically, in elevation, another embodiment of-the ramps.

The description of the preferred embodiment carries into practice helixes comprising 1.25 turns. FIG. 18 illustrates schematically another variant, in which the helixes 330, 330' of the first pair (the second pair not being shown in this figure) comprise four turns.

In this case, the feed means 47 position sheet 331*a* in the free space of the first turn 330*a* (respectively 330'*a*) and on the base portion 332 (respectively 332') of each of the two helixes 330 (respectively 330'). Sheet 331*a* is similarly positioned on the base portion of the helixes of the second pair not shown in FIG. 18.

Helixes 330, 330' comprise, in accordance with the variant of the invention described here, a free end 335 (respectively 335,), the output of the device being disposed on the upper side of the turns, and, in particular, above their free ends 335, 3357.

To convey a sheet positioned on the predetermined portion of base 332 (respectively 332') of helixes 330, 330' on the upper side of the latter (for example sheet 331*e*), four revolutions of helixes must be performed. Assuming that the last whole turn is followed by a fraction of a turn, a number of rotations corresponding to the number of whole turns plus said fraction must be performed to convey a sheet on the top.

This fraction of a turn is performed during the passage of the last sheet in the device, in order to convey it to the output of the device. A complement of a turn may accordingly be performed in order to obtain a complete turn that replaces the helixes in the initial position.

However, after each whole turn of a helix, a new sheet can be accepted at the input of the device, the helixes being in an adequate position to receive this sheet at their base, on the predetermined portion for the purpose 332, 332'.

In this way, since the sheets are fed after each turn of the helix, this feed is virtually continuous, contrary to the variants, in which a sheet is first placed on the free ends of the device before accepting the next sheet.

It is thus observed, in the embodiment in FIG. 18, that four sheets 331*a*, 331*b*, 331*c* and 331*d* can be simultaneously in the conveyance phase in each of the turns 330*a* to 330*d* (respectively 330'*a* to 330'*d*), thus increasing the drying time and the printing speed.

Other variants serve to improve the conveyance of the printed sheets from the input of the device to its output.

To facilitate the entry of the sheets on the predetermined portion for receiving the sheets, a portion of input can be arranged, as shown in the enlargements in FIGS. 14*a* and 14*b* concerning details of FIG. 14. Each of the helixes 65, 65' thus has, at its base, a doubly chamfered external excrescence 60, 60' offering a support 61 (61,) enabling the sheet leaving the printing system to enter more easily at the base of helixes 65, 65' and a guide 62 (62,) of the sheet intended to position it during its insertion in the helixes. These excrescences can also form part as a variant of the base. These excrescences form part of this variant of the "guide and placement means".

For the same purpose, the diameter of the helixes can be enlarged at the base without however changing the position of their rotation axes.

Figure 15:
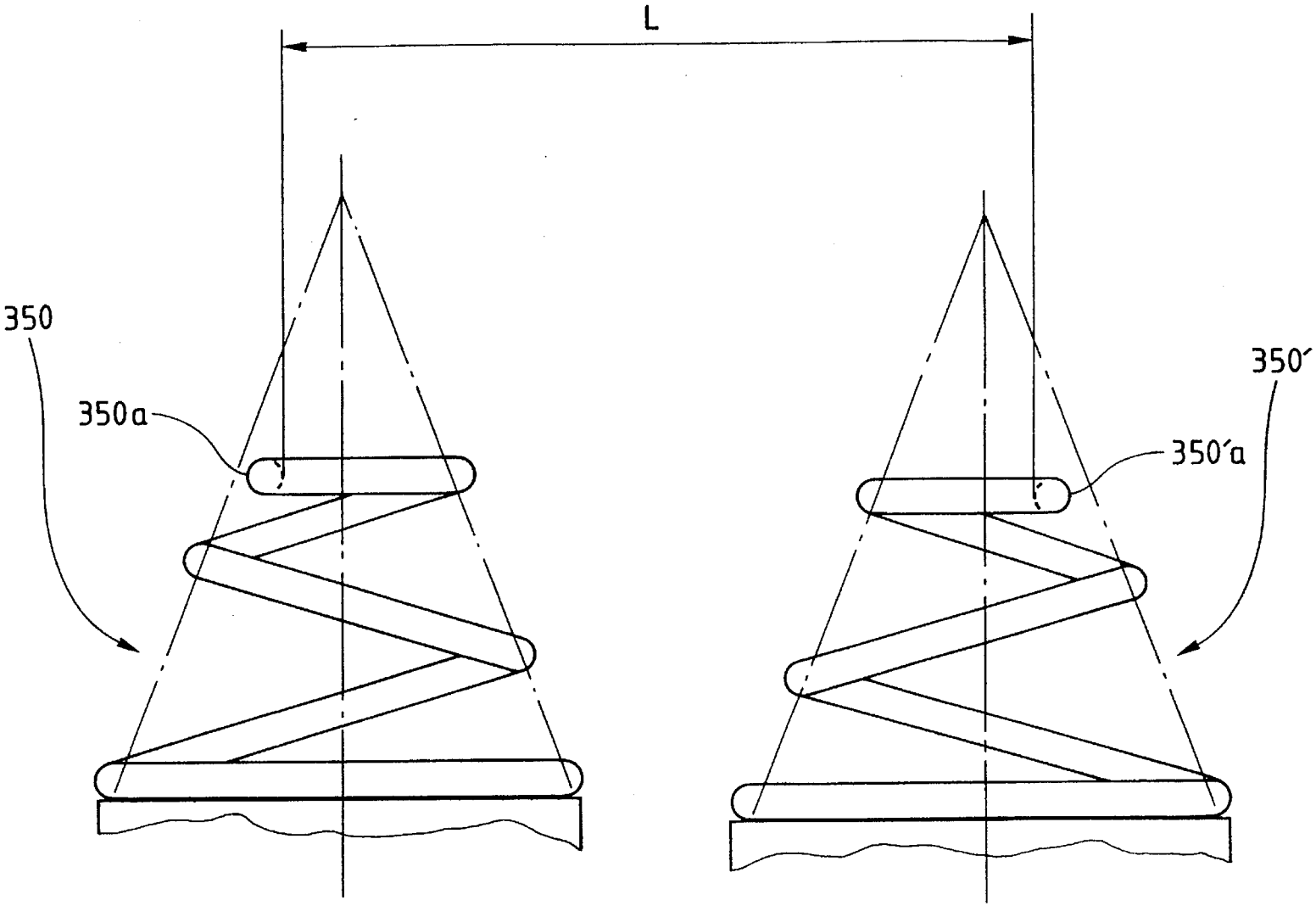

According to a variant, it is possible to use conical helixes of which a pair 350, 350' is shown in elevation in FIG. 15. Their diameters decrease in the downstream direction, i.e. in the conveyance direction of sheets 71 and hence, here, towards the free ends 350*a*, 350'*a*, while preserving at these free ends a configuration with a gap L (as defined above), slightly greater than the width 1 of sheet 71.

Figure 16:
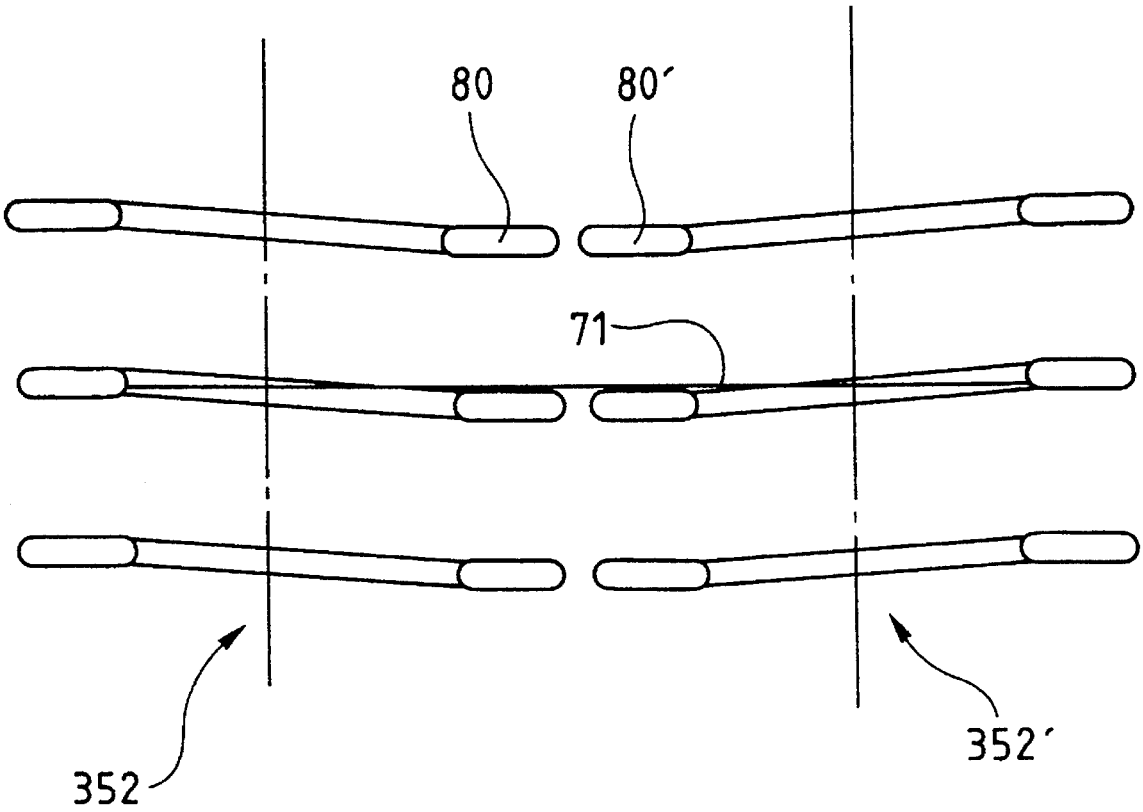
FIG. 16 illustrates, schematically, in an axial crosssection, another variant of the ramps.

In other variants of the device according to the invention, the cross-section of the helixes may be of a different shape. It may have a conventional round shape (FIG. 4), or an oblong shape, such as those of sections 80, 80' of FIG. 16 showing a cross-section view of a pair of helixes 352, 352'. The cross-section may also be rectangular.

Figure 17:
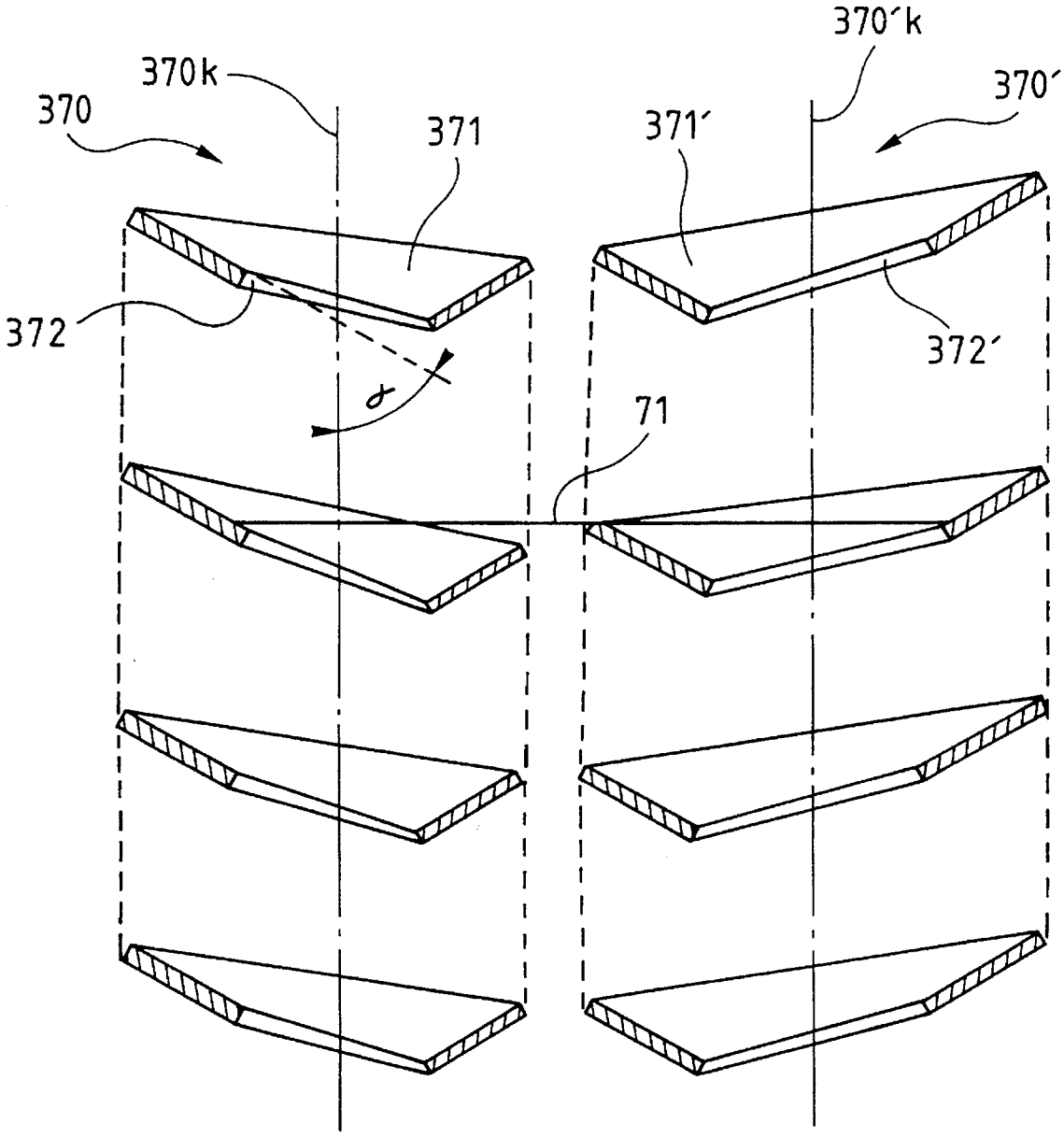
FIG. 17 illustrates, schematically, in an axial crosssection, a further variant of the ramps.

FIG. 17 shows a variant in which ramps 370, 370' comprise a track 371 (371') inclined downward in the direction of axis 370*k*, 370'*k*. Track 371 develops along a helicoidal surface generated by the progression of a rectilinear generating line perpendicular to a helicoidal director curve and travelling on the latter while forming a constant angle α of a predetermined value with axis 370*k*, 370'*k*.

In FIG. 17, it may be observed that the crosssection oriented along the aforementioned angle α, while the edge of the inclined track 371 symbolizes the helicoidal axis.

This arrangement helps to prevent sheet 71 from hooking onto the interior edge of the concerned helix. It helps in fact to offset towards the interior of the helix the internal edge 372 of track 371 (respectively internal edge 372' of track 371').

This arrangement also favors the guiding of sheet 71 during its conveyance.

It may also be useful to supplement the guiding of the sheet during its upward movement between the turns of helixes 33, 33', 34, 34' by a guide relief 85 (forming part in this embodiment of the "guide and placement means") (FIG. 3) made on the lateral wall 32a of frame 32. This guide relief, of rectangular shape, guides sheet 71 laterally during its upward movement, with its side 86 facing helixes 33', 34'.

In the preferred embodiment of the device, according to the invention, shown in FIGS. 2 and 3, the seizure of the printed sheet 71, after storage, is carried out by the user through the extraction slot 91, the width of said slot being at least equal to the length of the sheets 71.

This slot is made in the lateral wall 32*c* facing the free ends 33*a*, 33'*a*, 34*a*, 34'*a* of the first and second pairs of helixes 33, 33' and 34, 34' with parallel axes.

Through variants, it is possible to facilitate the seizure of these sheets by the user.

Figure 22:
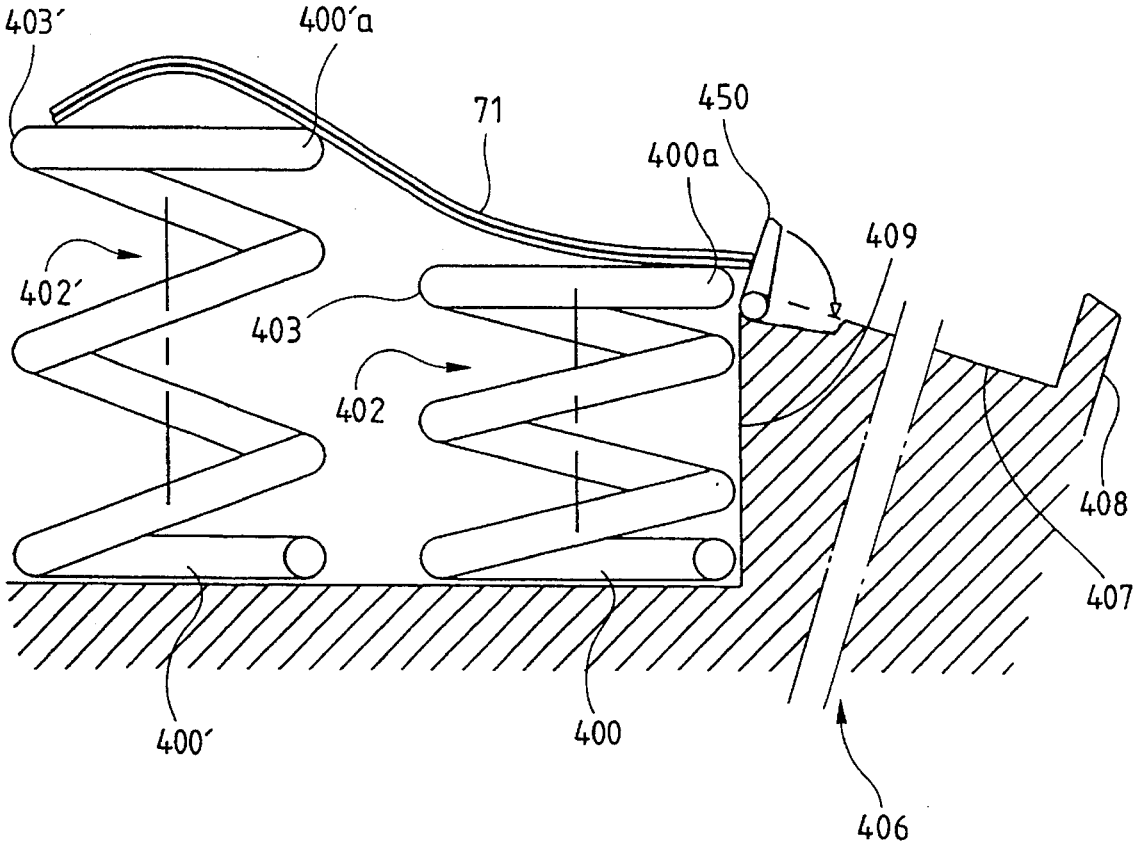
FIG. 22 shows, schematically, in elevation, another variant of the device.

We shall now describe a first embodiment of these variants by reference to FIG. 22.

FIG. 22 schematically shows this embodiment in an elevation view of a pair of helixes 400, 400' forming part of the device with two pairs of helixes, of which the second, arranged parallel and downstream from the first 400, 400' has not been shown in FIG. 22. The free ends 400*a*, 400'*a* are preceded by the last turns 402, 402' whose terminal portions 403, 403' are inscribed in a horizontal plane.

Helix 400' has a height greater than that of helix 400.

A receiving tray 406 (FIG. 22) forming a retaining means for the printed sheets 71 is arranged next to the lower helix 400 so that its bottom 407 approximately prolongs the inclined plane formed by the sheets 71 arriving on the top of helixes 400, 400'.

A retractable abutment 450 is placed in the prolongation of the wall 409 of the tray 406 facing the low helix 400.

Thus, by rotating helixes 400, 400', the sheet 71 are inclinably collated on the free ends 400*a*, 400'*a* of these helixes and are maintained in this position by abutment 450.

After collating a predetermined number of sheets, abutment 450 is retracted, following a signal from the control device, and the sheets then slide by gravity into the receiving tray 406 while retaining their order of arrival.

The lateral wall 408 retains the sheets in the tray 406.

It goes without saying that, if there is no need to preserve the order of arrival of the sheets, abutment 450 can be deleted in a variant of the device described, by reference to FIG. 22, in which case the sheets simply slide by gravity into the receiving tray.

The greater height of helix 400' is obtained by adding to it, in a first case, one or more turns, while preserving the same pitch as that of helix 400, or, in a second case, for the same number of turns as helix 400, by increasing the pitch of helix 400'.

It is understood, in the first case, that, in order to bring sheet 71 simultaneously on the ends 400*a* and 400'*a* of helixes 400 and 400', it is consequently necessary to increase the rotation speed of the first helix 400' in relation to that of the second helix 400.

In the second case, by varying the pitch of helix 400' or even helix 400, it is possible to incline sheet 71 in advance during its conveyance along a desired angle of inclination at the level of the free ends 400*a* and 400'*a* of helixes 400, 400'.

The observations made for helixes 400 and 400' are the same for both corresponding helixes 401, 401' of the pair of helixes arranged downstream (not shown) and forming part of the device described in this FIG. 22.

Figure 23A:
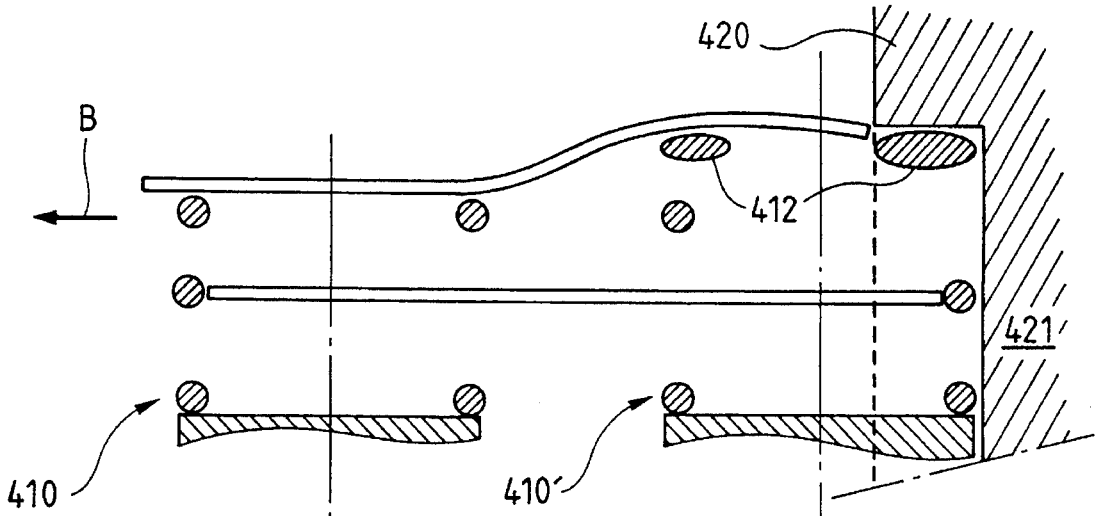
FIG. 23*a* is a schematic axial cross-sectional view showing another variant of the device.

In a second variant (FIGS. 23*a* and 23*b*), it is possible to use helical ramps, here comprising more than one turn, of which the cross-section of the last turn or of the terminal portion of the ramp is progressively enlarged in the direction of the free end in order to increase the contact surface and, consequently, the friction between the sheet and the ramp, and hence to make the sheet advance by friction towards the output of the device. FIG. 23*a* shows such a variant in a schematic longitudinal cross-section of a pair of helical ramps 410, 410' forming part of this second variant comprising four ramps (410, 410', 411, 411') seen from above in FIG. 23*b*. This FIG. 23*a* shows such a cross-section 412 preceding the free end 410'*a* of helix 410' placed on the opposite side of the output of the device, a cross-section that is larger than that of the rest of the turns of the same helix.

This last turn with an increasingly large crosssection (which constitutes possible friction enhancing means), will thus drive by friction sheet 71 toward the output of the device placed here facing the second helical ramp 410, due to the increase in the friction forces exerted by said last turn of ramp 410' with respect to those exerted by the last turn of ramp 410 adjacent to the output (shown by arrow B).

It may also be observed that ramp 410' as in FIG. 22, has a height greater than that of ramp 410, by having an additional turn for the same pitch. This makes it possible in particular for sheet 71 to avoid being caught in helix 410 during its lateral sliding.

Thus, when sheet 71 reaches the free end 410*a* of helix 410, helix 410, begins its additional turn, and the enlargement of its cross-section 412 ensures that sheet 71 is driven toward helix 410, enabling it, after this lateral sliding by friction effect, to slide by gravity toward the output B.

Figure 23B:
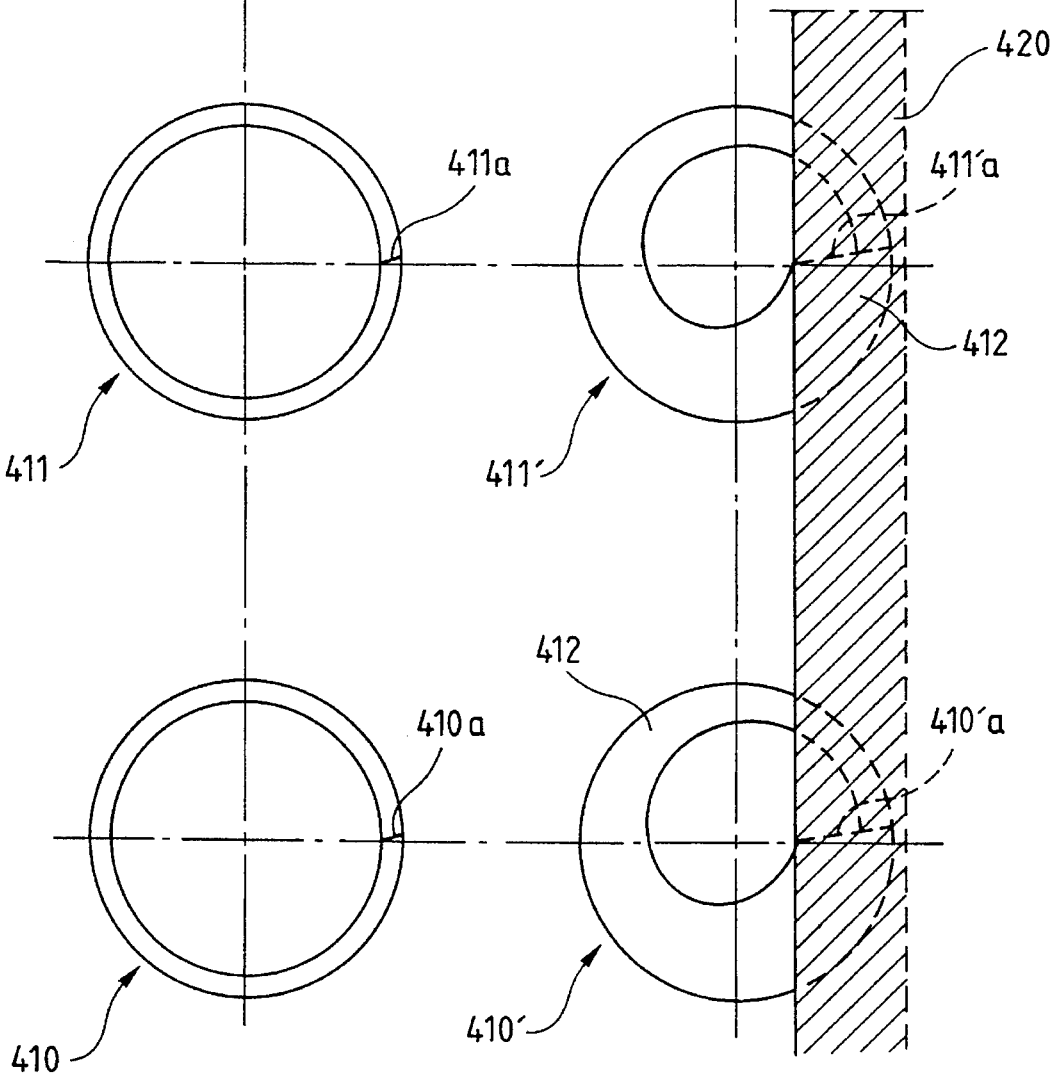
FIG. 23*b* is a simplified schematic plan view of the device in FIG. 23*a*, and, FIG. 24 shows, schematically, in a plan view, another variant of the device.

As also shown in FIGS. 23*a* and 23*b*, this variant also has an overhang 420 in a lateral wall 421 of the device, arranged facing the first ramp 410', that is to say on the opposite side of the lateral output of the device.

This overhang 420 overlies the first ramp 410' over the width of the section 412.

During its lateral sliding toward the output B of the device, sheet 71 can thus no longer return backwards.

It is also possible to enhance this friction effect by using a first background helix 410' whose diameter is greater than that of helix 410 placed facing the output of the device, in order to increase more substantially the cross-section of helix 410'.

Furthermore, because the second helix 410 has a smaller diameter than that of helix 410' it offers less support to the sheet driven toward it by helix 410', facilitating the sliding by gravity in the direction of the output B of the device.

All the observations made for helixes 410 and 410' are also valid respectively for helixes 411 and 411' forming part of the variant in FIGS. 23*a* and 23*b*.

It goes without saying that, in other variants according to the invention, it is possible to combine, by adapting, the features of the devices described by reference to FIGS. 22, 23*a* and 23*b*, in particular in the case of the use of a receiving tray.

Figure 24:
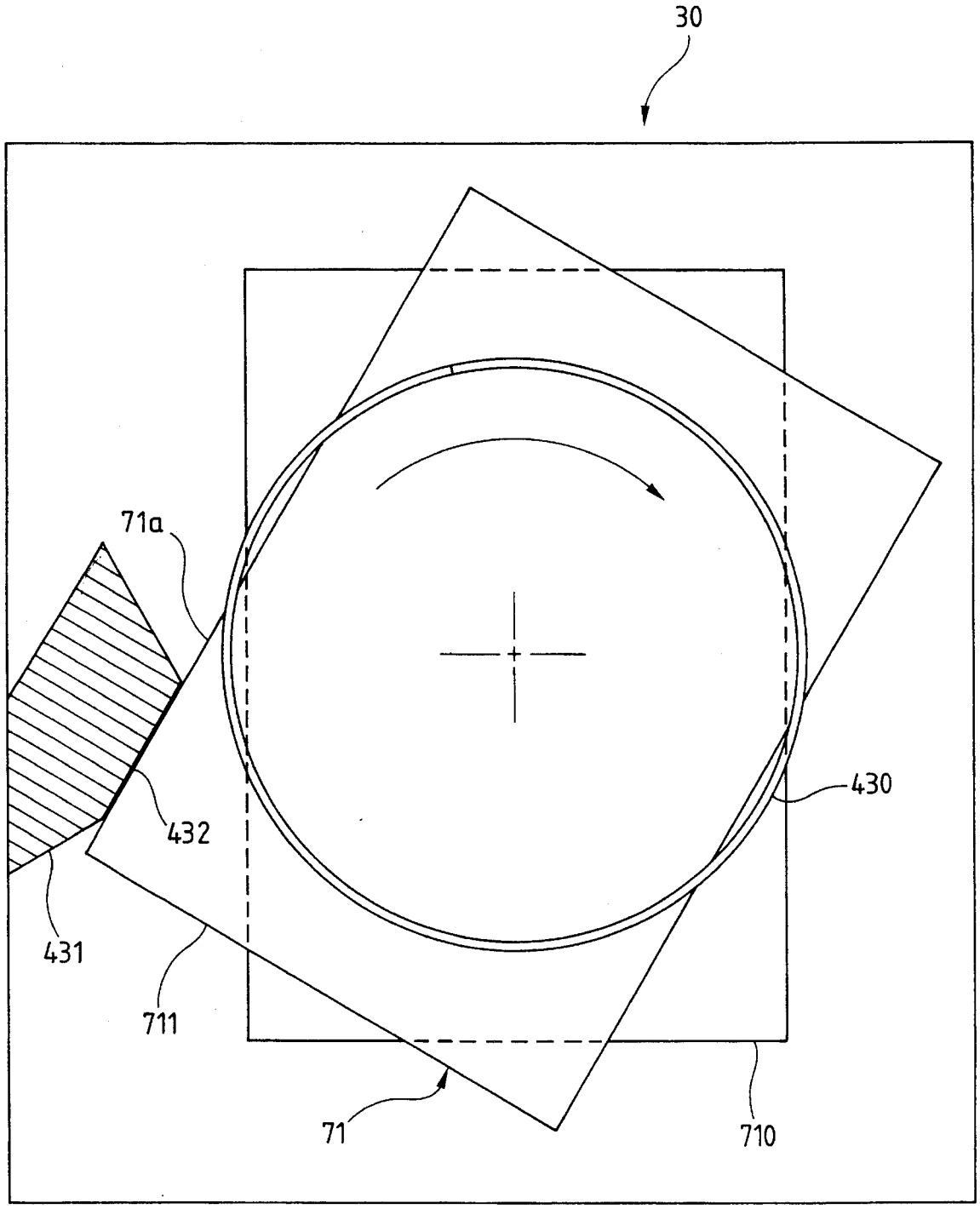

We shall now describe by reference to FIG. 24 an embodiment of the invention comprising a single helical ramp.

Helical ramp 430 has a diameter that is substantially greater than that of sheet 71. It also has a small winding angle.

According to the invention, it is rotated, and in this embodiment, this rotation is in the opposite direction to the winding direction, so that sheet 71 travels from the bottom upward. In addition, its end is free.

In this embodiment, the "guide and placement means" consist, on the one hand, of a fixed abutment 431, integral with the structure of the device, and, on the other hand, the interior and upper edge of said ramp 430, in accordance with what has been described above, in particular by reference to FIGS. 5 and 5*a*. In the embodiment described by reference to FIGS. 5 and 5*a*, the lateral placement and guiding is performed by each of the ramps of the pairs which have in particular an opposite winding for this purpose. In the embodiment in FIG. 24, the fixed abutment 431 makes up for the absence of a second ramp, by offering a guide and placement surface 432 for the edge 71*a* of sheet 71.

In the embodiment shown in FIG. 24, another particularly advantageous feature is also carried into practice. Sheet 71 is ejected by the feed means and is positioned on the portion of the base of ramp 430 with a predetermined orientation, shown by reference 710. This arrangement is intended to obtain a different orientation of the sheets at the output of the device to facilitate their seizure by the user. The change in orientation of the sheet (which goes from the position shown by reference 710 to that shown by reference 711), is made possible by the friction force existing between the ramp 430 and the sheet 71, in particular due to the large diameter of ramp 430. Thus, when the ramp is rotated, it accordingly drives sheet 71 (then in the position shown by reference 710), until sheet 71 stops against the guide and placement surface 432 (position 711). The rotation of sheet 71 is accordingly converted into an upward movement of the sheet toward the free end of turn 430.

Abutment 431 can be arranged in a lateral wall of the device such as one of those shown in FIGS. 2 and 3.

Obviously the present invention is in no way limited to the embodiments shown and described here, but, on the contrary, it includes all variants within the scope of the understanding of those skilled in the art.

In particular, the number of helical ramps is unrestricted. By reference to the figures, two families of variants have been described in which the number of ramps is respectively four and one. Other intermediate alternatives are possible (for example, two ramps arranged one following the other or one next to the other, or three ramps arranged at the apexes of a triangle). Those skilled in the art will find, in the present description, the information necessary to carry into practice the guide and placement means necessary for these variants and for others.

In addition, it may be observed that, in the variants described, the upper end of the helical ramps is free, while the sheets travel from the bottom upward inside these ramps. These features are in no way indispensable for carrying into practice the present invention. The helical ramps may not have free ends, the sheets being conveyed by means of the helical ramp or ramps between two predetermined turns. Furthermore, this conveyance can also be performed from the top downward. The rotation speeds can also be adjusted to the types of sheet conveyed (for example, fragile sheets) and to the configurations of each of the helixes.

The axes of the helical ramps can have any orientation necessitated by mechanical constraints. In particular, these axes can be arranged to be horizontal.

Finally, it is also understood that the application of the device to the field of office automation is not limitative.

We claim:

1. A device for collating sheets having at least two edges which are offered to an input of the device, comprising:

conveyor means adapted to convey the sheets in a circuit arranged between the input and an output of the device, the conveyor means comprising at least a first pair of helical ramps having inner and upper areas and a predetermined winding direction and each comprising a free end, the ramps being arranged on rotating means adapted to rotate them about their helix axis in the opposite direction to the winding direction; and sheet guide and placement means, the rotation of the ramps conveying the sheet placed by said sheet guide and placement means, on a predetermined portion of each of the two ramps, along at least part of said circuit and toward the free end of said ramps, a first of the two ramps of said pair having, in relation to the second, a reverse winding, wherein the sheet guide and placement means comprise the inner and upper areas of each of the ramps, said helical ramps being arranged in order that said inner and upper areas come into contact with the sheet edges approximately transversely to the movement of arrival of the sheet to guide it laterally.

2. A device according to claim 1, further comprising a second pair of ramps, arranged downstream from said first pair in relation to the movement of arrival of the sheets.

3. A device according to claim 2, wherein the first ramps and the second ramps of each of the two pairs have respectively an identical winding direction.

4. A device according to claim 2, wherein the first ramps of each of the two pairs have a height greater than that of the second ramps of each of the two pairs.

5. A device according to claim 2, wherein rotation gears associated with the first pair of ramps and rotation gears associated with the second pair of ramps mesh, so that the ramps of the first pair and the ramps of the second pair are rotated in opposite directions.

6. A device according to claim 5, wherein the bases of the ramps comprise nesting projections whose shapes are Complementary to those of recesses formed in the gears of the associated rotating means.

7. A device according to claim 6, wherein the complementary shapes of the nesting projections and the recesses are identical respectively for the first ramps and the second ramps.

8. A device according to claim 1, wherein the free end of each of the ramps is preceded by a circular portion of turn inscribed in a horizontal plane.

9. A device for collating sheets which are offered to an input of the device, comprising:

conveyor means adapted to convey the sheets in a circuit arranged between the input and output of the device, the conveyor means comprising at least a first pair of helical ramps having a predetermined winding direction and each comprising a free end, the ramps being arranged on rotating means adapted to rotate them about their helix axis in the opposite direction to the winding direction;

sheet guide and placement means, the rotation of the ramps conveying the sheet positioned by said sheet guide and placement means, on a predetermined portion of each of the two ramps, along at least part of said circuit and toward the free end of said ramps, a first of the two ramps of said pair having, in relation to the second, a reverse winding; and a second pair of ramps, arranged downstream from said first pair in relation to the movement of arrival of the sheets, the first ramps and the second ramps of each of the two pairs having respectively an identical winding direction and the first ramps of each of the two pairs having a height greater than that of the second ramps of each of the two pairs.

10. A device according to any one of claims 1 or 9, wherein the rotating means associated with each of the ramps comprise at least one gear on which the ramp is disposed, and the conveyor means comprise a motor for rotating the gears associated with each of the ramps.

11. A device according to claim 10, wherein the ramps each comprise a base adapted to allow mounting and demounting of the ramps on the complementary forms of a portion at least of the associated rotation gears.

12. A device according to any one of claims 1 or 9, wherein the sheet guide and placement means are formed of the sheet ejecting means, after printing, of a printer.

13. A device according to any one of claims 1 or 9, wherein the sheet guide and placement means comprise an abutment.

14. A device according to any one of claims 1 or 9, wherein associated with the rotating means is a rotation counter device associated with an electronic control device, which synchronizes the positioning of the ramps in relation to the input of a sheet into the device by transmitting activation and deactivation signals to the motor driving the rotating means and to sheet feed means.

15. A device according to claim 14, wherein the rotation counter device comprises a roller switch associated with the rotating means.

16. A device according to any one of claims 1 or 9, further comprising an overflow feeling device connected to an electronic control device, placed at a predetermined distance from the free end of the ramps.

17. A device according to any one of claims 1 or 9, wherein the ramps are inscribed in a cone, the diameter of the turns decreasing in the downstream direction.

18. A device according to any one of claims 1 or 9, wherein the ramps have, at their base, facing the rotating means, a doubly chamfered internal excrescence guiding the sheet into the predetermined portion of the corresponding ramp.

19. A device according to claim 18, further comprising friction enhancing means arranged on the terminal part, near the free end of the first ramps.

20. A device according to claim 19, wherein an overhang overlies the friction enhancing means of the first ramps on a portion at least of their width.

21. A device according to claim 20, wherein the friction enhancing means comprise a section enlargement of the terminal part, near the free end of the first ramps.

22. A device according to claim 21, wherein at least one guide relief is formed near the exterior edges of the first ramps or the second ramps.

23. A device according to one of claims 2 or 9, wherein the diameter of the first ramps is greater than the diameter of the second ramps.

24. A device according to one of claims 2 or 9, wherein the rotation speed of the first ramps is greater than the rotation speed of the second ramps.

25. A device according to claim 24, further comprising a detector responsive to the presence of the base.

26. A device according to any one of claims 4 or 9, wherein a retaining and receiving means is arranged laterally to the second ramps of each of the two pairs.

27. A device according to claim 26, wherein a retractable abutment is arranged at the interface of the retaining means and of the free end of the second ramps.

28. A device according to claim 9, wherein the free end of each of the ramps is preceded by a circular portion of a turn inscribed in a horizontal plane.

29. A device according to claim 9 or claim 28, wherein each of the ramps comes into contact with the sheet approximately transversely to the movement of arrival of the sheet to guide it laterally.

30. A device according to claim 29, wherein the sheet guide and placement means comprise the interior and upper edges of each of the ramps.

* * * * *

UNITED STATES PATENT AND TRADEMARK OFFICE

CERTIFICATE OF CORRECTION

PATENT NO. : 5,480,135 Page 1 of 3

DATED : January 2, 1996

INVENTOR(S) : Nagane et al.

It is certified that error appears in the above-indentified patent and that said Letters Patent is hereby corrected as shown below:

[57] ABSTRACT:

Line 3, "convey" should read --conveys--; and
Line 8, "rotate" should read --rotates--.

COLUMN 1:

Line 11, "sheet," should read --sheets,--; and
Line 20, "some" should read --Some--.

COLUMN 3:

Line 67, "crosssection" should read --cross-section--.

COLUMN 5:

Line 27, "lamps," should read --ramps,--.
Line 27, "or" should read --of-- (both occurrences);
Line 28, "crosssection," should read --cross-section,--;
Line 30, "crosssection," should read --cross-section,--; and
Line 33, "of-the" should read --of the--.

COLUMN 6:

Line 47, "example" should read --example,--;
Line 49, "34,a)" should read --34'a)--; and
Line 67, "helixes 34, 34,." should read --helixes 34, 34'.--.

COLUMN 7:

Line 29, "bases" should read --bases 33i--;
Line 39, "331'," should read --33'1,--;

UNITED STATES PATENT AND TRADEMARK OFFICE

CERTIFICATE OF CORRECTION

PATENT NO. : 5,480,135 Page 2 of 3

DATED : January 2, 1996

INVENTOR(S) : Nagane et al.

It is certified that error appears in the above-indentified patent and that said Letters Patent is hereby corrected as shown below:

Line 43, "example" should read --example,--;
Line 55, "(arrow B" should read --(arrows B--; and
Line 58, "Thus" should read --Thus,--.

COLUMN 10:

Line 33, "34,)" should read --34')--.

COLUMN 12:

Line 11, "34'" should read --34',--;
Line 26, "335,)," should read --335'),--;
Line 28, "3357." should read --335'.--;
Line 63, "(61,)" should read --(61')--; and
Line 65, "(62,)" should read --(62')--.

COLUMN 13:

Line 26, "crosssection" should read --cross-section of track 371 is rectangular. This cross-section is--.

COLUMN 14:

Line 3, "sheet 71" should read --sheets 71--;
Line 50, "crosssection" should read --cross-section--;
Line 57, "ramp 410'" should read --ramp 410',--; and
Line 64, "helix 410," should read --helix 410'--.

COLUMN 15:

Line 15, "helix 410'" should read --helix 410',--.

UNITED STATES PATENT AND TRADEMARK OFFICE

CERTIFICATE OF CORRECTION

PATENT NO. : 5,480,135 Page 3 of 3

DATED : January 2, 1996

INVENTOR(S) : Nagane et al.

It is certified that error appears in the above-indentified patent and that said Letters Patent is hereby corrected as shown below:

COLUMN 17:

Line 2, "claim 5," should read --claim 11,--; and
Line 4, "Complementary" to --complementary--.

Signed and Sealed this

Seventeenth Day of September, 1996

*Attest:*

Bruce Lehman

BRUCE LEHMAN

*Attesting Officer*

*Commissioner of Patents and Trademarks*